US010229640B2

(12) United States Patent
Miyata et al.

(10) Patent No.: US 10,229,640 B2
(45) Date of Patent: Mar. 12, 2019

(54) LIQUID CRYSTAL DISPLAY DEVICE AND METHOD FOR DRIVING SAME

(71) Applicant: SHARP KABUSHIKI KAISHA, Sakai, Osaka (JP)

(72) Inventors: Hidekazu Miyata, Sakai (JP); Masamitsu Kobayashi, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 15/555,169

(22) PCT Filed: Feb. 24, 2016

(86) PCT No.: PCT/JP2016/055360
§ 371 (c)(1),
(2) Date: Sep. 1, 2017

(87) PCT Pub. No.: WO2016/140119
PCT Pub. Date: Sep. 9, 2016

(65) Prior Publication Data

US 2018/0053474 A1 Feb. 22, 2018

(30) Foreign Application Priority Data

Mar. 2, 2015 (JP) ..... 2015-039869

(51) Int. Cl.
*G09G 3/34* (2006.01)
*G09G 3/36* (2006.01)

(52) U.S. Cl.
CPC ..... *G09G 3/3413* (2013.01); *G09G 3/3607* (2013.01); *G09G 3/3648* (2013.01);
(Continued)

(58) Field of Classification Search
CPC ..... G09G 2300/0452; G09G 2310/08; G09G 2320/0242; G09G 2320/062;
(Continued)

(56) References Cited

U.S. PATENT DOCUMENTS

2005/0041047 A1* 2/2005 Miyata ..... G09G 3/3611 345/690
2007/0176943 A1* 8/2007 Cho ..... G09G 3/3413 345/589

(Continued)

FOREIGN PATENT DOCUMENTS

WO 2010/084619 A1 7/2010
WO 2011/132455 A1 10/2011
WO 2014/185109 A1 11/2014

*Primary Examiner* — Richard J Hong
(74) *Attorney, Agent, or Firm* — ScienBiziP, P.C.

(57) ABSTRACT

A liquid crystal display device employing a field sequential system includes: a color correction unit (122) configured to perform a color correction processing that changes a saturation of input gradation data representing a color of a pixel without changing a hue thereof and configured to output pixel data obtained by the color correction processing as digital gradation data (D1 to D3) which are data corresponding to each field; and a digital gradation data correction unit configured to perform correction that enhances a temporal change of data values of digital gradation data (D1 to D3) outputted from the color correction unit (122). The color correction unit (122) performs the color correction processing on the input gradation data such that a color based on pixel data obtained by the color correction processing is a color that can be displayable in the liquid crystal panel by the field sequential system.

13 Claims, 35 Drawing Sheets

(52) U.S. Cl.
CPC ... *G09G 3/3688* (2013.01); *G09G 2300/0452* (2013.01); *G09G 2310/0235* (2013.01); *G09G 2310/08* (2013.01); *G09G 2320/028* (2013.01); *G09G 2320/0242* (2013.01); *G09G 2320/0252* (2013.01); *G09G 2320/062* (2013.01); *G09G 2320/10* (2013.01); *G09G 2340/00* (2013.01); *G09G 2360/16* (2013.01)

(58) Field of Classification Search
CPC .. G09G 3/3413; G09G 3/3607; G09G 3/3648; G09G 3/3406; G09G 3/3611; G09G 3/3688; G09G 2340/00; G09G 2310/0235; G09G 2320/028; G09G 2320/10; G09G 2360/16
See application file for complete search history.

(56) References Cited

U.S. PATENT DOCUMENTS

| | | | | |
|---|---|---|---|---|
| 2011/0181635 | A1* | 7/2011 | Kabe | G09G 3/3426 345/694 |
| 2012/0069062 | A1* | 3/2012 | Ishihara | G09G 3/3611 345/690 |
| 2013/0010017 | A1 | 1/2013 | Kobayashi et al. | |
| 2016/0071449 | A1 | 3/2016 | Miyata et al. | |
| 2016/0104444 | A1* | 4/2016 | Miyata | G09G 3/3406 345/205 |

* cited by examiner

Fig.15
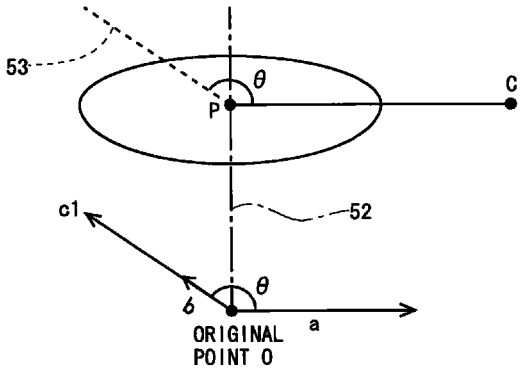
Fig.16
| m | cos θ | L a |
|---|---|---|
| ..... | ..... | ..... |
| ..... | ..... | ..... |
| ..... | ..... | ..... |
| ..... | ..... | ..... |
| ..... | ..... | ..... |
| ⋮ | ⋮ | ⋮ |
Fig.17
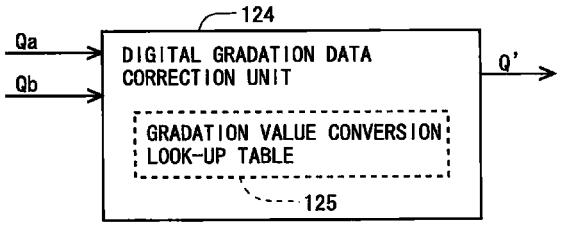

125

DISPLAY FIELD VALUE

PRECEDING FIELD VALUE

| | 0 | 32 | 64 | 96 | 128 | 160 | 192 | 224 | 255 |
|---|---|---|---|---|---|---|---|---|---|
| 0 | 0 | 34 | 70 | 108 | 144 | 207 | 240 | 255 | 255 |
| 32 | 0 | 32 | 65 | 100 | 140 | 193 | 238 | 255 | 255 |
| 64 | 0 | 30 | 64 | 98 | 138 | 187 | 224 | 254 | 255 |
| 96 | 0 | 28 | 58 | 96 | 132 | 181 | 212 | 250 | 255 |
| 128 | 0 | 25 | 55 | 83 | 128 | 165 | 210 | 245 | 255 |
| 160 | 0 | 19 | 49 | 80 | 122 | 160 | 208 | 240 | 255 |
| 192 | 0 | 16 | 48 | 81 | 114 | 142 | 192 | 230 | 255 |
| 224 | 0 | 10 | 34 | 61 | 108 | 130 | 181 | 224 | 255 |
| 255 | 0 | 0 | 32 | 58 | 102 | 124 | 172 | 208 | 255 |

| m | L z |
|---|---|
| ..... | ..... |
| ..... | ..... |
| ..... | ..... |
| ..... | ..... |
| ..... | ..... |
| ⋮ | ⋮ |

1228

DISPLAY FIELD VALUE

| PRECEDING FIELD VALUE | 0 | 32 | 64 | 96 | 128 | 160 | 192 | 224 | 255 |
|---|---|---|---|---|---|---|---|---|---|
| 0 | 1 | 1 | 1 | 1 | 1 | 1 | 1 | 0 | 0 |
| 32 | 1 | 1 | 1 | 1 | 1 | 1 | 1 | 0 | 0 |
| 64 | 0 | 1 | 1 | 1 | 1 | 1 | 1 | 1 | 0 |
| 96 | 0 | 1 | 1 | 1 | 1 | 1 | 1 | 1 | 0 |
| 128 | 0 | 1 | 1 | 1 | 1 | 1 | 1 | 1 | 0 |
| 160 | 0 | 1 | 1 | 1 | 1 | 1 | 1 | 1 | 0 |
| 192 | 0 | 1 | 1 | 1 | 1 | 1 | 1 | 1 | 0 |
| 224 | 0 | 1 | 1 | 1 | 1 | 1 | 1 | 1 | 0 |
| 255 | 0 | 1 | 1 | 1 | 1 | 1 | 1 | 1 | 1 |

LIQUID CRYSTAL DISPLAY DEVICE AND METHOD FOR DRIVING SAME

TECHNICAL FIELD

The present invention relates to a liquid crystal display device and a driving method thereof, and more specifically to a technique of suppressing occurrence of color shift in a liquid crystal display device employing a field sequential system.

BACKGROUND ART

In general, in a liquid crystal display device that performs color display, one pixel is divided into three sub pixels of a red pixel, a green pixel, and a blue pixel, the red pixel being provided with a color filter that transmits red light, the green pixel being provided with a color filter that transmits green light, the blue pixel being provided with a color filter that transmits blue light. While color display is possible by use of the color filters provided in the three sub pixels, about two-thirds of backlight light applied to a liquid crystal panel is absorbed in the color filters. Hence a liquid crystal display device employing a color filter system has a problem of low efficiency in light utilization. Attention has thus been focused on a liquid crystal display device employing the field sequential system which performs color display without using color filters.

In a typical liquid crystal display device employing the field sequential system, one frame period, which is a display period for one screen, is divided into three fields. Although field is also referred to as sub frame, the term "field" will be used throughout the following description. For example, one frame period is divided into: a field (red field) that displays a red screen based on a red component of an input image signal; a field (green field) that displays a green screen based on a green component of the input image signal; and a field (blue field) that displays a blue screen based on a blue component of the input image signal. By displaying the primary colors one by one as described above, a color image is displayed on the liquid crystal panel. Since the color image is displayed in this manner, the color filters are not required in the liquid crystal display device employing the field sequential system. Accordingly, the efficiency in light utilization of the liquid crystal display device employing the field sequential system is about three times as high as that of the liquid crystal display device employing the color filter system. The liquid crystal display device employing the field sequential system is thus suited for high luminance and lower power consumption.

It should be noted that, in this specification, a color specified by a combination of a data value of a red component, a data value of a green component, and a data value of a blue component (a combination of a data value of a red component, a data value of a green component, a data value of a blue component, and a data value of a white component in a case in which a field that displays a white is provided) while considering display order of colors in a frame is referred to as "order color" for the sake of convenience. For example, a color specified by "first field: R=128, second field: G=32, third field: B=255" is one order color. In this example, colors are displayed in the order of "red, green, blue" in each frame. A data value of a red component is 128, a data value of a green component is 32, and a data value of a blue component is 255. A data value is typically a gradation value.

Meanwhile, in the liquid crystal display device, an image is displayed by controlling a transmittance of each pixel with a voltage (liquid crystal application voltage). In this regard, it takes several milliseconds for the transmittance at a pixel to attain a target transmittance from the start of writing data (applying a voltage) into the pixel, as shown in FIG. 44. Hence in the liquid crystal display device employing the field sequential system, in each field, a backlight of the corresponding color is switched from an unlighted state to a lighted state after the liquid crystal has responded to some extent. Namely, in the liquid crystal display device employing the field sequential system, the backlight is turned on only in a part of the latter half of each field (for example, a period indicated by reference character T9 in FIG. 44).

Further, in the liquid crystal display device, a sufficient image quality may not be obtained, for example at the time of displaying a moving image, due to a low response speed of the liquid crystal. Then, as one of measures against the low response speed of the liquid crystal, a drive system called overdrive (overshooting drive) has conventionally been adopted. The overdrive is a drive system in which the liquid crystal panel is supplied with a drive voltage higher than a predetermined gradation voltage corresponding to a data value of an input image signal in the current frame or a drive voltage lower than a predetermined gradation voltage corresponding to a data value of an input image signal in the current frame in accordance with a combination of a data value of an input image signal in the preceding frame and a data value of an input image signal in the current frame. That is, the overdrive leads to correction of an input image signal that emphasizes (not a spatial change but) a temporal change in a data value. By adopting such an overdrive, in the liquid crystal display device employing the color filter system, the liquid crystal makes a response such that the transmittance at a pixel attains the target transmittance in each field.

It should be noted that, regarding the present invention, WO 2010/084619 A discloses an invention in which the overdrive is applied to the liquid crystal display device employing the field sequential system.

PRIOR ART DOCUMENT

Patent Document

[Patent Document 1] WO 2010/084619 A

SUMMARY OF THE INVENTION

Problems to be Solved by the Invention

In the liquid crystal display device employing the field sequential system described above, since one frame period is typically divided into three fields, a length of a period for writing data to each pixel is one-third of that in the liquid crystal display device employing the color filter system. Therefore, even in a case in which the overdrive is adopted, depending on the magnitude of the change in a data value of the input image signal from a preceding field, a transmittance at a pixel may not reach a target transmittance within one field as shown in FIG. 45 (see a portion denoted by reference character 90). This will be further explained. In a current general liquid crystal display device, a source driver capable of output ting only voltages corresponding to gradation values from 0 to 255, for example, is used. That is, the source driver provided in the current general liquid crystal display device can not output an expanded voltage (a voltage outside the range of the voltages corresponding to gradation values from 0 to 255). Therefore, for example, in a case in which a gradation value in the preceding field is 0 and a gradation value in the current field is 255, it is not possible to correct the gradation voltage so as to increase a response speed of the liquid crystal. Accordingly, as shown in FIG. 45, the transmittance at the pixel does not reach the target transmittance within one field. If the source driver is configured to enable output of the expanded voltage, there is no choice but to reduce the displayable gradation values. In this case, the display luminance is lowered.

Moreover, also in terms of "step response of the liquid crystal", it is difficult for the transmittance at the pixel to reach the target transmittance within one field. Here, "step response of liquid crystal" will be described. When data is written to the pixel, turning on and turning off of the TFT (pixel TFT) is performed in the pixel formation portion, when the TFT is turned off, a charge accumulated in a pixel electrode is held. However, since the response of the liquid crystal is not completed in a very short time, the liquid crystal continues to respond by the electric field even after the TFT changes from an on state to an off state. Here, the relationship "Q=CV" is established between an electric charge Q, a capacitance C, and a voltage V. When the liquid crystal responds after the TFT is turned off, the capacitance C between the electrodes changes, and the voltage V also changes such that the relationship "Q=CV" is satisfied. Therefore, liquid crystal does not respond to the extent that the target transmittance is obtained by writing to the pixel only once. Accordingly, in the liquid crystal display device employing the color filter system, the liquid crystal appears to respond over several frames. The phenomenon that the liquid crystal responds over several frames in such a manner is referred to as "step response of liquid crystal".

Meanwhile, when a still image is displayed on the liquid crystal display device employing the color filter system, once an image is displayed, the liquid crystal is maintained in a constant state throughout the period until another image is displayed (the liquid crystal does not move). Therefore, an influence of the response characteristics of the liquid crystal on the display quality is relatively small. On the other hand, in the liquid crystal display device employing the field sequential system, a gradation value changes for each field, except when colorless display is performed. Thus, normally, a state of the liquid crystal changes for each field. Further, as described above, in the liquid crystal display device employing the field sequential system, due to the fact that one frame period is divided into a plurality of fields (for example, three fields) and due to the step response of liquid crystal, in each field, the transmittance at the pixel often does not reach the target transmittance until the field makes a transition to a next field. In view of the above, in the liquid crystal display device employing the field sequential system, color shift frequently occurs when color display is performed.

Here, with reference to FIGS. 46 to 48, phenomena when white, red, and yellow images are displayed in the liquid crystal display device employing the field sequential system will be described. It is assumed that this liquid crystal display device can perform gradation display of 256 gradations, and that one frame period includes a red field, a green field, and a blue field. In FIGS. 46 to 48, "MIN" represents a transmittance corresponding to a gradation value 0, and "MAX" represents a transmittance corresponding to a gradation value 255. When a white image is displayed, the liquid crystal is maintained in a constant state as shown in FIG. 46. For this reason, a white image is displayed without causing color shift. When a red image is displayed, a state of the liquid crystal changes as shown in FIG. 47. When paying attention to the red field, since a change in the gradation value from the blue field of the preceding frame is large, the transmittance at the pixel does not reach the target transmittance as indicated by reference character 91. For this reason, red is not displayed at a desired luminance. Also, when paying attention to the green field, since a change in the gradation value from the red field is large, the transmittance at the pixel does not reach the target transmittance as indicated by reference character 92. For this reason, although green color should not be displayed, green color is displayed. From the above, when a red image is displayed, color shift occurs. When a yellow image is displayed, a state of the liquid crystal changes as shown in FIG. 48. When paying attention to the red field, since a change in the gradation value from the blue field of the preceding frame is large, the transmittance at the pixel does not reach the target transmittance as indicated by reference character 93. For this reason, red is not displayed at a desired luminance. Also, when paying attention to the blue field, since a change in the gradation value from the green field is large, the transmittance at the pixel does not reach the target transmittance as indicated by reference character 94. For this reason, although the blue color should not be displayed, the blue color is displayed. From the above, when a yellow image is displayed, color shift occurs.

As described above, in the liquid crystal display device employing the field sequential system, color shift occurs when an image including an order color (for example, a color specified by "first field: R=255, second field: G=0, third field: B=0" as shown in FIG. 47) which causes a field in which the transmittance at the pixel does not reach the target transmittance is displayed. Schematically, for example, when color display as indicated by reference character 97 in FIG. 49 is to be performed, color display indicated by reference character 98 in FIG. 49 is performed.

Accordingly, an object of the present invention is to realize a liquid crystal display device employing the field sequential system and capable of suppressing occurrence of color shift.

Means for Solving the Problems

A first aspect of the present invention is directed to a liquid crystal display device employing a field sequential system, the liquid crystal display device having a backlight including light sources of a plurality of colors and configured to perform color display by switching a lighting pattern representing a combination of a lighted state and an unlighted state of the light sources of the plurality of colors in every field, the liquid crystal display device including:

a liquid crystal panel configured to display an image;

a color correction unit configured to perform a color correction processing that changes a saturation of input pixel data representing a color of a pixel without changing a hue thereof and configured to output pixel data obtained by the color correction processing as digital gradation data which are data corresponding to each field;

a digital gradation data correction unit configured to perform correction that enhances a temporal change of data values of digital gradation data outputted from the color correction unit; and a liquid crystal panel driving unit configured to drive the liquid crystal panel based on digital gradation data after correction by the digital gradation data correction unit; and the color correction unit performs the color correction processing on the input pixel data such that a color based on pixel data obtained by the color correction processing is a color that can be displayable in the liquid crystal panel by the field sequential system.

According to a second aspect of the present invention, in the first aspect of the present invention, the color correction unit includes a field allocating unit configured to allocate data of a plurality of colors to a respective field based on display order of colors in a frame, the data of the plurality of colors being included in the input pixel data, and a correction calculation unit configured to perform a calculation processing using a calculation circuit, as the color correction processing, and the correction calculation unit performs the calculation processing based on order data that are data obtained by allocating the data of the plurality of colors to the respective field by the field allocating unit, without considering colors in the frame.

According to a third aspect of the present invention, in the first aspect of the present invention, when the color indicated by the input pixel data is a color outside a displayable range in the field sequential system, the color correcting unit performs the color correction processing on the input pixel data such that a color based on pixel data obtained by the color correction processing is a color corresponding to a part, among a region representing the displayable range, that is in contact with a region outside the displayable range, on the color space.

According to a fourth aspect of the present invention, in the third aspect of the present invention, when, on the color space, a color indicated by the input pixel data is represented by a point C, an intersection of the plane including the point C and having an achromatic axis as a normal and the achromatic axis is represented by a point P, and a point corresponding to a color based on pixel data after correction is represented by D, the color correction unit decides on a distance from the point P to the point D based on coordinates of the point P and an angle between a line segment PC and a straight line obtained by projecting one axis forming the color space on the plane having the achromatic axis as a normal.

According to a fifth aspect of the present invention, in the third aspect of the present invention, when, on the color space, a color indicated by the input pixel data is represented by a point C, an intersection of the plane including the point C and having an achromatic axis as a normal and the achromatic axis is represented by a point P, and a point corresponding to a color based on pixel data after correction is represented by D, the color correction unit decides on a distance from the point P to the point D based on coordinates of the point P.

According to a sixth aspect of the present invention, in the first aspect of the present invention, when, on the color space, a color indicated by the input pixel data is represented by a point C, an intersection of the plane including the point C and having an achromatic axis as a normal and the achromatic axis is represented by a point P, a point corresponding to a color based on pixel data after correction is represented by D, a distance from a part, among a region representing a displayable range, that is in contact with a region outside the displayable range to the point P is represented by La, and a maximum value that can be taken as a distance from the point P to a point corresponding to a color indicated by the input pixel data is represented by Lmax, the color correction unit decides on a distance from the point P to the point D such that a ratio of a length of a line segment PC to Lmax is equal to a ratio of a length of a line segment PD to La.

According to a seventh aspect of the present invention, in the first aspect of the present invention, one frame period is divided into a plurality of fields, the number of the fields is larger than the number of lighting patterns, and a cycle in which a same lighting pattern appears is shorter than a cycle in which input pixel data for one frame period are inputted.

According to an eighth aspect of the present invention, in the first aspect of the present invention, one frame period includes a field in which light sources of two or more colors among the light sources of the plurality of colors are turned on.

According to a ninth aspect of the present invention, in the eighth aspect of the present invention, the light sources of the plurality of colors include red light sources, green light sources, and blue light sources, and one frame period is divided into four or more fields including a red field in which only the red light sources are turned on, a green field in which only the green light sources are turned on, a blue field in which only the blue light sources are turned on, and a white field in which the red light sources, the green light sources, and the blue light sources are turned on, the four or more fields including at least one field as the red field, at least one field as the green field, at least one field as the blue field, and at least one field as the white field.

According to a tenth aspect of the present invention, in the ninth aspect of the present invention, when, on the color space, a color indicated by the input pixel data is represented by a point C, and an intersection of the plane including the point C and having an achromatic axis as a normal and the achromatic axis is represented by a point P, the color correction unit sets points on a line segment CP as target processing points one by one from the point C to the point P, determines whether or not each of the target processing points is a point corresponding to a color inside a displayable range, and decides on, based on the determination result, coordinates of a point corresponding to a color based on pixel data after correction.

According to an eleventh aspect of the present invention. In the tenth aspect of the present invention, the color correction unit allocates data corresponding to each lighting pattern to the four or more fields, the data corresponding to each lighting pattern being obtained by performing a processing that separates a white component from data of each of the target processing points, and when response is possible in all of the four or more fields, the color correction unit makes a determination that a target processing point is a point corresponding to a color inside the displayable range.

According to a twelfth aspect of the present invention, in the first aspect of the present invention, when any field among fields included in each frame period is defined as a focused field, a data value of digital gradation data corresponding to the focused field is defined as a display field value, and a data value of digital gradation data corresponding to a preceding field of the focused field is defined as a preceding field value, the digital gradation data correction unit corrects the display field value obtained by the color correction unit depending on the preceding field value obtained by the color correction unit.

According to a thirteenth aspect of the present invention, in the twelfth aspect of the present invention, the liquid crystal display device further includes a field memory that can hold digital gradation data, for one screen, corresponding to a last field of each frame period among digital gradation data obtained by the color correction unit.

According to a fourteenth aspect of the present invention, in the first aspect of the present invention, the liquid crystal panel includes pixel electrodes arranged in matrix, a common electrode arranged to face the pixel electrodes, a liquid crystal sandwiched between the pixel electrodes and the common electrode, scanning signal lines, video signal lines to which video signals depending on digital gradation data after correction by the digital gradation data correction unit are applied, and thin film transistors each having a control terminal connected to one of the scanning signal lines, a first conduction terminal connected to one of the video signal lines, and a second terminal connected to one of the pixel electrodes, a channel layer of each of the thin film transistors are formed with an oxide semiconductor.

According to a fifteenth aspect of the present invention, in the fourteenth aspect of the present invention, main components of the oxide semiconductor include an indium, a gallium, a zinc, and an oxygen.

A sixteenth aspect of the present invention is directed to a method of driving a liquid crystal display device employing a field sequential system, the liquid crystal display device having a liquid crystal panel configured to display an image and a backlight including light sources of a plurality of colors and configured to perform color display by switching a lighting pattern representing a combination of a lighted state and an unlighted state of the light sources of the plurality of colors in every field, the method including:

a color correction step of performing a color correction processing that changes a saturation of input pixel data representing a color of a pixel without changing a hue thereof and outputting pixel data obtained by the color correction processing as digital gradation data which are data corresponding to each field;

a digital gradation data correction step of performing correction that enhances a temporal change of data values of digital gradation data outputted by the color correction step; and a liquid crystal panel driving step of driving the liquid crystal panel based on digital gradation data after correction by the digital gradation data correction step; and in the color correction step, the color correction processing is performed on the input pixel data such that a color based on pixel data obtained by the color correction processing is a color that can be displayable in the liquid crystal panel by the field sequential system.

Effects of the Invention

According to the first aspect of the present invention, in a liquid crystal display device employing the field sequential system, correction processing that changes the saturation without changing the hue is performed on the input pixel data so that the color after correction is a color that can be displayable by the field sequential system. Since the impression received by a person with respect to the displayed image changes more significantly when the hue changes than when the lightness or the saturation changes, occurrence of color shift is suppressed by performing color correction without changing the hue in this way. From the above, a liquid crystal display device employing the field sequential system and capable of suppressing occurrence of color shift is realized.

According to the second aspect of the present invention, before the color correction processing is performed, processing of allocating data of a plurality of colors to fields is performed in accordance with display order of colors in the frame. Then, in the correction calculation unit, calculation processing is performed based on order data obtained by this allocation. That is, in the correction calculation unit, calculation processing is performed without considering colors in the frame. Since such a configuration is adopted, it is possible to simplify the calculation circuit in the correction calculation unit. Thus, an effect of cost reduction due to reduction in circuit scale can be obtained.

According to the third aspect of the present invention, regarding data of a color that can not be displayed, correction is performed so that the hue does not change and the variation amount for the saturation is as small as possible. Accordingly, occurrence of large color shift is suppressed when a color image is displayed.

According to the fourth aspect of the present invention, similarly to the third aspect of the present invention, occurrence of large color shift is suppressed when a color image is displayed.

According to the fifth aspect of the present invention, the same effect as in the third aspect of the present invention can be obtained with a relatively small memory capacity.

According to the sixth aspect of the present invention, correction is performed on the input pixel data so that data of all colors are data of colors that can be displayed and gradation display can be performed also regarding high saturation colors. Thus, a liquid crystal display device employing the field sequential system, capable of suppressing occurrence of color shift, and capable of performing gradation display also regarding high saturation colors is realized.

According to the seventh aspect of the present invention, one frame period is divided into a plurality of fields, the number of fields is larger than the number of prepared lighting patterns. Then, the cycle in which the same lighting pattern appears is shorter than the cycle in which input pixel data for one frame is inputted. Thus, the frequency of luminance change based on each lighting pattern is increased more than before. As a result, occurrence of flicker is suppressed. From the above, a liquid crystal display device employing the field sequential system and capable of suppressing occurrence of color shift and occurrence of flicker is realized.

According to the eighth aspect of the present invention, one frame period includes a field in which displaying of the mixed color component is performed. Accordingly, occurrence of color breakup is suppressed. From the above, a liquid crystal display device employing the field sequential system and capable of suppressing occurrence of color shift while suppressing occurrence of color breakup is realized.

According to the ninth aspect of the present invention, one frame period includes a field in which displaying of the mixed color components of the three primary colors is performed, in addition to three fields in which monochromatic display of each of the three primary colors is performed. Accordingly, occurrence of color breakup is suppressed more effectively. From the above, a liquid crystal display device employing the field sequential system and capable of suppressing occurrence of color shift while suppressing occurrence of color breakup effectively is realized.

According to the tenth aspect of the present invention, regarding data of a color that can not be displayed, correction is performed so that the hue does not change and the variation amount for the saturation is as small as possible. Accordingly, occurrence of large color shift is suppressed when a color image is displayed. From the above, a liquid crystal display device employing the field sequential system and capable of effectively suppressing occurrence of color breakup and occurrence of color shift is realized.

According to the eleventh aspect of the present invention, the same effect as in the tenth aspect of the present invention can be obtained.

According to the twelfth aspect of the present invention, since the correction amount of the data value when performing overdrive (a difference between a data value before correction and a data value after correction) is determined depending on data value of the preceding field, it is possible to cause the transmittance at each pixel to reach the target transmittance within each field more accurately. Thus, occurrence of color shift is more effectively suppressed.

According to the thirteenth aspect of the present invention, when the correction for overdrive is performed on data of the first field of each frame, it is possible to compare the data value of the first field of the target frame with the data value of the last field of the preceding frame. Thus, when displaying of moving image is performed, correction for overdrive can be effectively performed on data of the first field of each frame. Accordingly, in the liquid crystal display device employing the field sequential system, occurrence of color shift is suppressed even when displaying of moving image is performed.

According to the fourteenth aspect of the present invention, in a liquid crystal display device employing the field sequential system, a thin film transistor in which a channel layer is formed of an oxide semiconductor is used as a thin film transistor provided in a liquid crystal panel. Therefore, in addition to obtaining the effect of high definition and low power consumption, writing speed can be increased as compared with the conventional case. Accordingly, occurrence of color shift is more effectively suppressed.

According to the fifteenth aspect of the present invention, it is possible to surely obtain the same effect as in the fourteenth aspect of the present invention by using indium gallium zinc oxide as the oxide semiconductor forming the channel layer.

According to the sixteenth aspect of the present invention, it is possible to obtain the same effect as in the first aspect of the present invention in a method of driving a liquid crystal display device employing the field sequential system.

BRIEF DESCRIPTION OF THE DRAWINGS

FIG. 15 is a diagram for explaining the color correction processing in the first embodiment.

FIG. 16 is a schematic diagram of a displayable range table in the first embodiment.

FIG. 17 is a diagram for explaining a digital gradation data correction unit in the first embodiment.

MODES FOR CARRYING OUT THE INVENTION

0. Introduction

Figure 2:
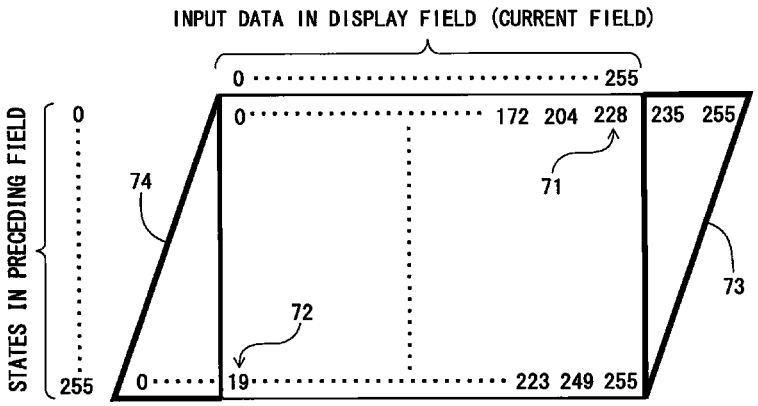
FIG. 2 is a diagram showing a relationship between "states of the liquid crystal in a preceding field" and "gradation values of the input data in a display field (a current field)" and "gradation values corresponding to the reaching transmittance".
Figure 3:
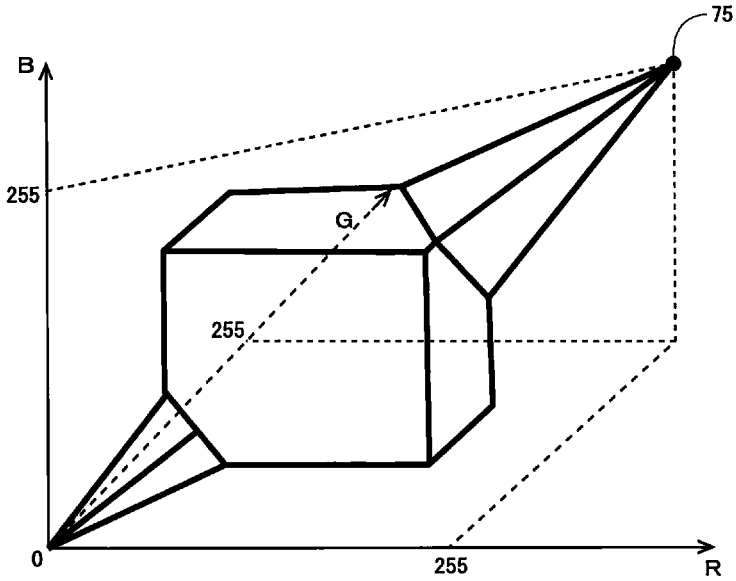
FIG. 3 is a schematic diagram showing an order color displayable range in a liquid crystal display device employing the field sequential system.
Figure 4:
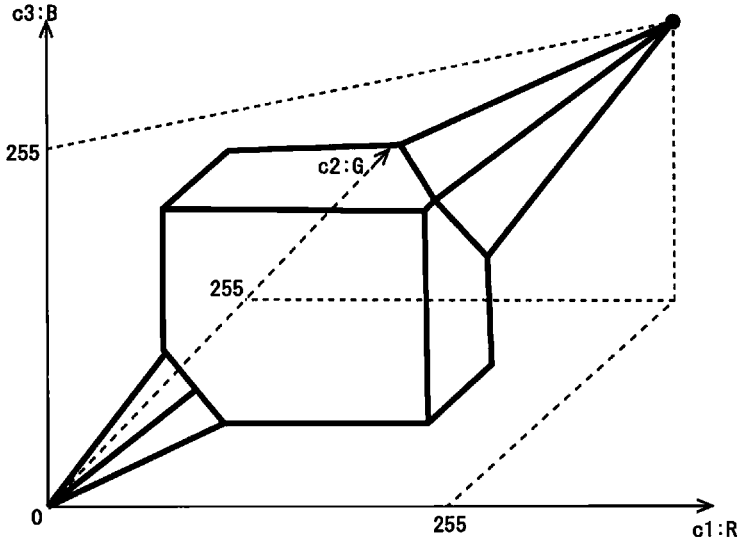
FIG. 4 is a diagram showing a display order color space when display order of colors in a frame is "red, green, blue".

Before explaining embodiments, the outline of the present invention will be described with reference to FIGS. 2 to 4. It should be noted that, in the description here and in the description of each embodiment (including modifications), a liquid crystal display device capable of gradation display of 256 gradations is taken as an example. FIG. 2 is a diagram showing a relationship between "states of the liquid crystal in a preceding field" and "gradation values of the input data in a display field (a current field)" and "gradation values corresponding to the reaching transmittance". It should be noted that a state of the liquid crystal in the preceding field is expressed in terms of gradation values. In FIG. 2, for example, when paying attention to a portion denoted by an arrow of reference character 71, it is grasped that "when a gradation voltage corresponding to the gradation value 255 is applied to the liquid crystal in a case in which a state of the liquid crystal in the preceding field is a state corresponding to the gradation value 0, a transmittance corresponding to the gradation value 228 is obtained". In addition, when paying attention to a portion denoted by an arrow of reference character 72 in FIG. 2, it is grasped that "when a gradation voltage corresponding to the gradation value 0 is applied to the liquid crystal in a case in which a state of the liquid crystal in the preceding field is a state corresponding to the gradation value 255, a transmittance corresponding to the gradation value 19 is obtained". Here, when the gradation value associated with the state of the liquid crystal in the preceding field is defined as "preceding gradation value" and the gradation value of the input data in the display field is defined as "current gradation value", regarding a relationship between the preceding gradation value and the current gradation value, there is a combination in which the transmittance at the pixel can not reach the target transmittance within one field. In FIG. 2, a portion denoted by reference character 73 and a portion denoted by reference character 74 represent ranges of colors corresponding to "a combination of the preceding gradation value and the current gradation value" in which the transmittance at the pixel can not reach the target transmittance within one field. For example, if the current gradation value is a value within the range from 235 to 255 when the preceding gradation value is 0, the transmittance at the pixel does not reach the target transmittance within one field. It should be noted that the relationship shown in FIG. 2 is an example and the relationship varies depending on the response characteristics of the liquid crystal panel.

Figure 47:
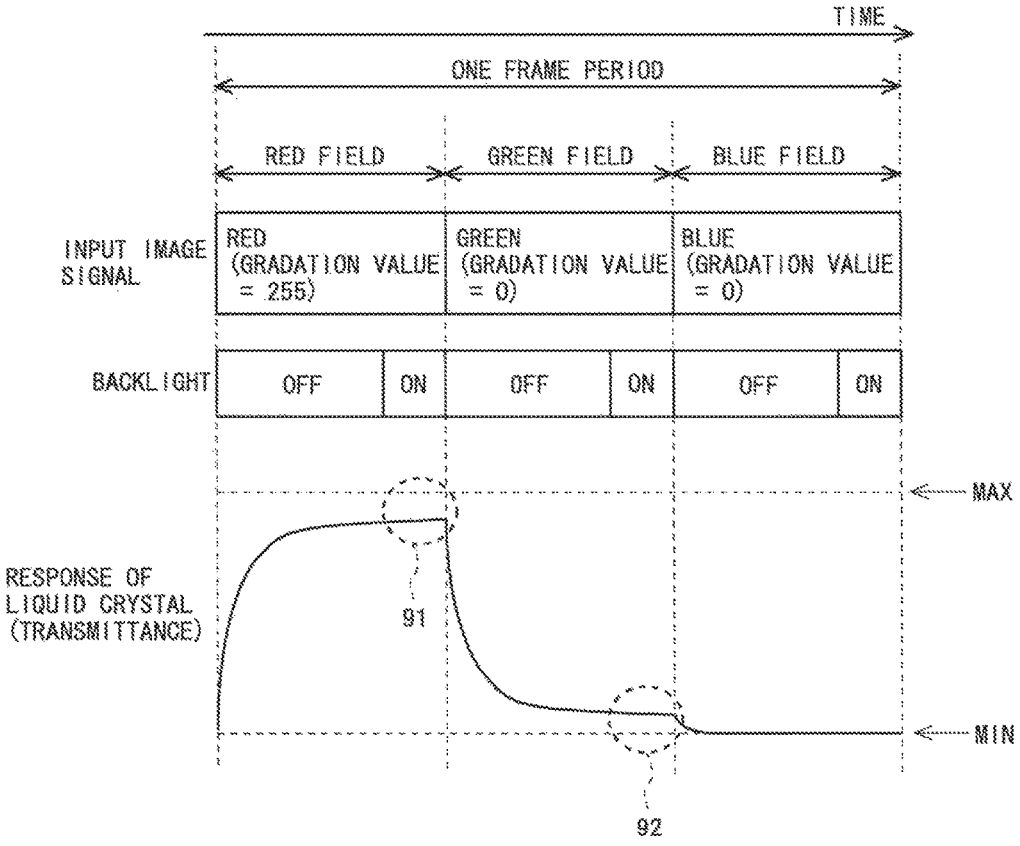
Fig.47 Prior Art
FIG. 47 is a diagram for explaining a phenomenon when a red image is displayed in the liquid crystal display device employing the field sequential system.
Figure 48:
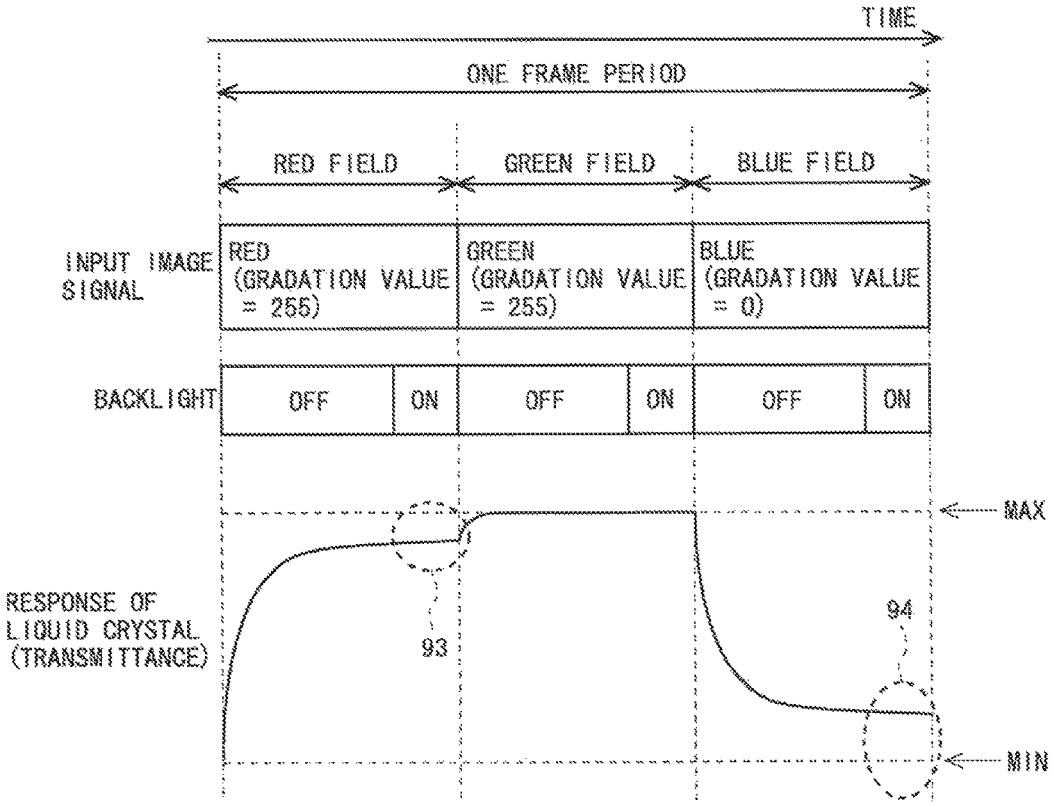
Fig.48 Prior Art
FIG. 48 is a diagram for explaining a phenomenon when a yellow image is displayed in the liquid crystal display device employing the field sequential system.
Figure 49:
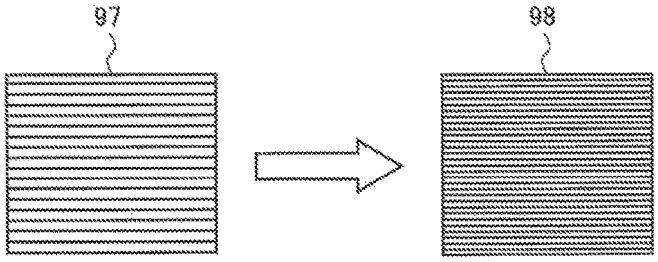
Fig.49 Prior Art
FIG. 49 is a diagram schematically showing an example of color shift.

In the liquid crystal display device employing the color filter system, it is possible to take gradation values from 0 to 255 regarding all of R, G, and B. On the other hand, in the liquid crystal display device employing the field sequential system, since there is "a combination of the preceding gradation value and the current gradation value" in which the transmittance at the pixel can not reach the target transmittance within one field as described above, there are order colors that can not be displayed. Therefore, the order colors that can be displayed in the liquid crystal display device employing the field sequential system are limited to the order colors inside an area indicated by the bold solid line in FIG. 3 schematically. It should be noted that the order color at the position denoted by reference character 75 in FIG. 3 is a color specified by "first field: R=255, second field: G=255, third field: B=255". Hereinafter, a range (area) represented by a set of displayable order colors is referred to as "order color displayable range" for the sake of convenience. In the liquid crystal display device employing the field sequential system, when trying to display an order color specified by "first field: R=255, second field: G=0, third field: B=0", for example, the transmittance at the pixel does not reach the target transmittance in the red field and the green field, as shown in FIG. 47. As a result, actually, a color corresponding to an order color specified by "R=228, G=16, B=0", for example, is displayed. That is, greenish red is displayed despite desiring to display red.

From the above, in the liquid crystal display device employing the field sequential system, color shift may occur when a color image is displayed. Therefore, in the present invention, a correction of the data value is performed on the image data so as not to cause color shift as much as possible. It should be noted that, in this specification, data that is the source of the image displayed on the display unit of the liquid crystal display device is collectively referred to as "image data". That is, the image data includes an input image signal, an input gradation data, a digital gradation data, and the like which will be described later.

By the way, although the order color displayable range varies depending on display order of colors in the frame, the order color displayable range does not vary in the color space in which allocation of colors to each field is performed. In this specification, a color space considering display order of colors in a frame is referred to as "display order color space". In addition, the three axes forming the display order color space are referred to as "c1 axis", "c2 axis", and "c3 axis", respectively. The c1 axis is the axis associated with a color displayed in the first field, the c2 axis is the axis associated with a color displayed in the second field, and the c3 axis is the axis associated with a color displayed in the third field. For example, when the display order of colors in the frame is "red, green, blue", the display order color space is formed by the c1 axis associated with red, the c2 axis associated with green, and the c3 axis associated with blue, as shown in FIG. 4. By using such a display order color space, the order color displayable range on the color space takes display order of colors into consideration. Accordingly, it is unnecessary to consider all possible display orders, and therefore the circuit scale is reduced and the cost is reduced.

Figure 5:
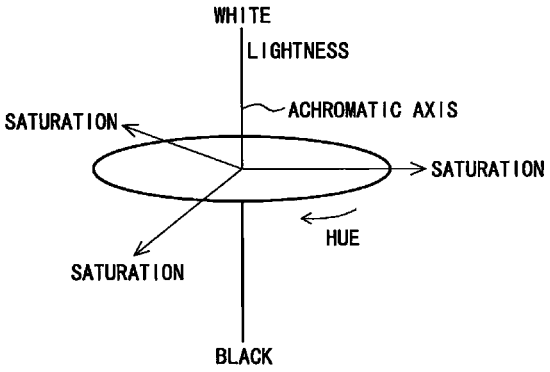
FIG. 5 is a diagram for explaining three psychological attributes of color.
Figure 6:
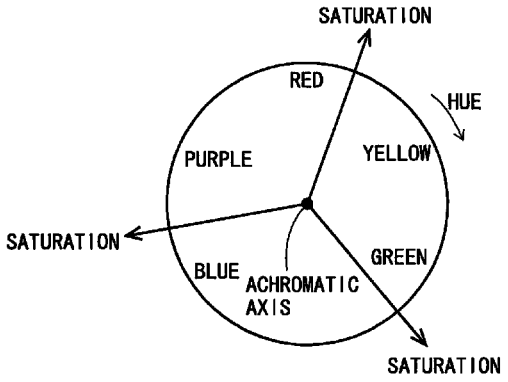
FIG. 6 is a diagram for explaining three psychological attributes of color.

Next, a concept common to all embodiments (including modifications) will be described. Generally, it is known that there are elements "hue", "lightness", and "saturation" which are called three psychological attributes in color. Hue is a color shade such as "red . . . yellow . . . green . . . blue . . . purple". Lightness is the degree of brightness of color. Saturation is the degree of color vividness. These three psychological attributes are generally shown in FIG. 5. In FIG. 5, the lightness is shown in the vertical direction, and the vertical line represents an achromatic axis. The lightness gets higher as the position above the achromatic axis and the lightness gets lower as the position below the achromatic axis. Also, the longer the distance from the achromatic axis is, the higher the saturation is. The hue is represented by the circumference in which there is the achromatic axis at the center. FIG. 6 is a top view of the three-dimensional space shown in FIG. 5. It is understood that colors such as "red . . . yellow . . . green . . . blue . . . purple" exist around the achromatic axis. By the way, since the hue represents color shade as described above, it is considered that the impression received by a person with respect to the displayed image changes more significantly when the hue changes than when the lightness or the saturation changes. Therefore, in the liquid crystal display device according to the present invention, in order to suppress the occurrence of color shift, processing for correcting image data outside the order color displayable range to image data inside the order color displayable range so as not to change the hue (Hereinafter referred to as "color correction processing") is performed.

Figure 7:
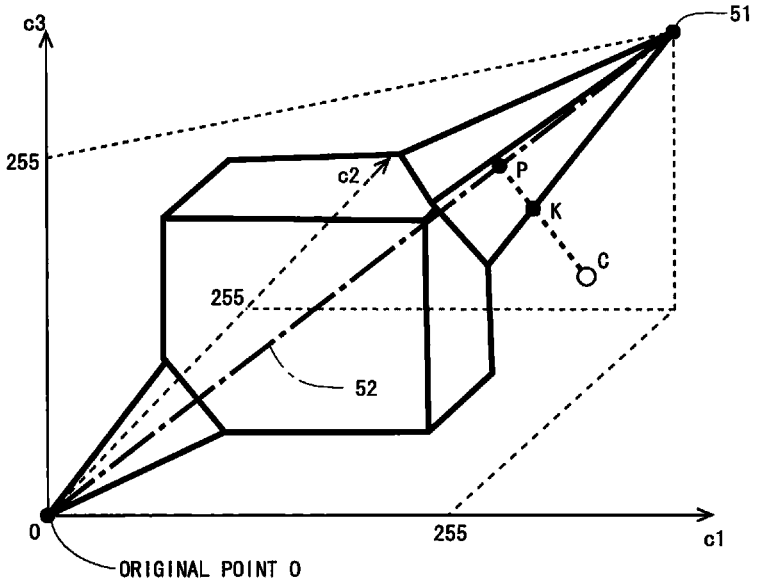
FIG. 7 is a diagram for explaining three psychological attributes in the display order color space (a color space considering display order of colors in a frame).
Figure 8:
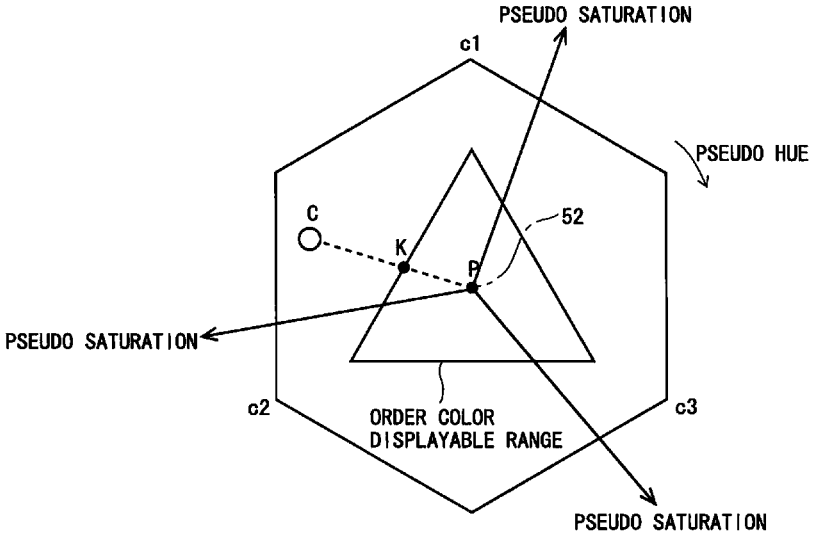
FIG. 8 is a diagram for explaining three psychological attributes in the display order color space.

Here, with reference to FIG. 7 and FIG. 8, the three psychological attributes in the display order color space is considered. A point denoted by reference character 51 in FIG. 7 is a point representing an order color in which all the data values of the first to third fields are 255. A straight line connecting the original point O and the point indicated by reference character 51 in FIG. 7 is a pseudo achromatic axis (hereinafter referred to as "pseudo achromatic axis") 52. Further, when paying attention to a certain point C in FIG. 7, the plane including the point C and having the pseudo achromatic axis 52 as a normal is represented as shown in FIG. 8. As shown in FIG. 8, the saturation (pseudo saturation) is represented by the distance from the pseudo achromatic axis 52, and the hue (pseudo hue) is represented by the circumference in which there is the pseudo achromatic axis 52 at center.

With reference to FIG. 7 and FIG. 8, it is described how the image data (data of the order color) outside the order color displayable range is corrected by the color correction processing. It should be noted that, in FIG. 7 and FIG. 8, the point P is an intersection point between the plane including the point C and having the pseudo achromatic axis 52 as a normal and the pseudo achromatic axis 52. That is, the point P is an achromatic point. Also, in FIG. 7 and FIG. 8, an intersection point between a line segment connecting the point P and the point C and the outermost portion of the order color displayable range is indicated by a point K. Also here, the point C is focused on, and it is assumed that the point C is a point representing an order color outside the order color displayable range. With respect to such data of the point C, the pseudo saturation is changed toward the achromatic point P on the plane having the pseudo achromatic axis 52 as a normal, so that the data after correction is data within the order color displayable range. Thus, a point representing an order color after correction in FIG. 7 and FIG. 8 is the point K or a point on a line segment connecting the point K and the point P. As described above, in the present invention, by changing the saturation while maintaining the hue, the image data outside the order color displayable range is corrected to the image data inside the order color displayable range.

Hereinafter, embodiments of the present invention will be described with reference to the accompanying drawings. It should be noted that, in the following description, a combination of a lighted state and an unlighted state of light sources (LEDs) of a plurality of colors prepared as a backlight is referred to as "lighting pattern". For example, a pattern such as "red LED: lighted state, green LED: unlighted state, blue LED: unlighted state" (only the red LED is lit) is one lighting pattern.

1. First Embodiment

<1.1 Overall Configuration and Operation Outline>

Figure 9:
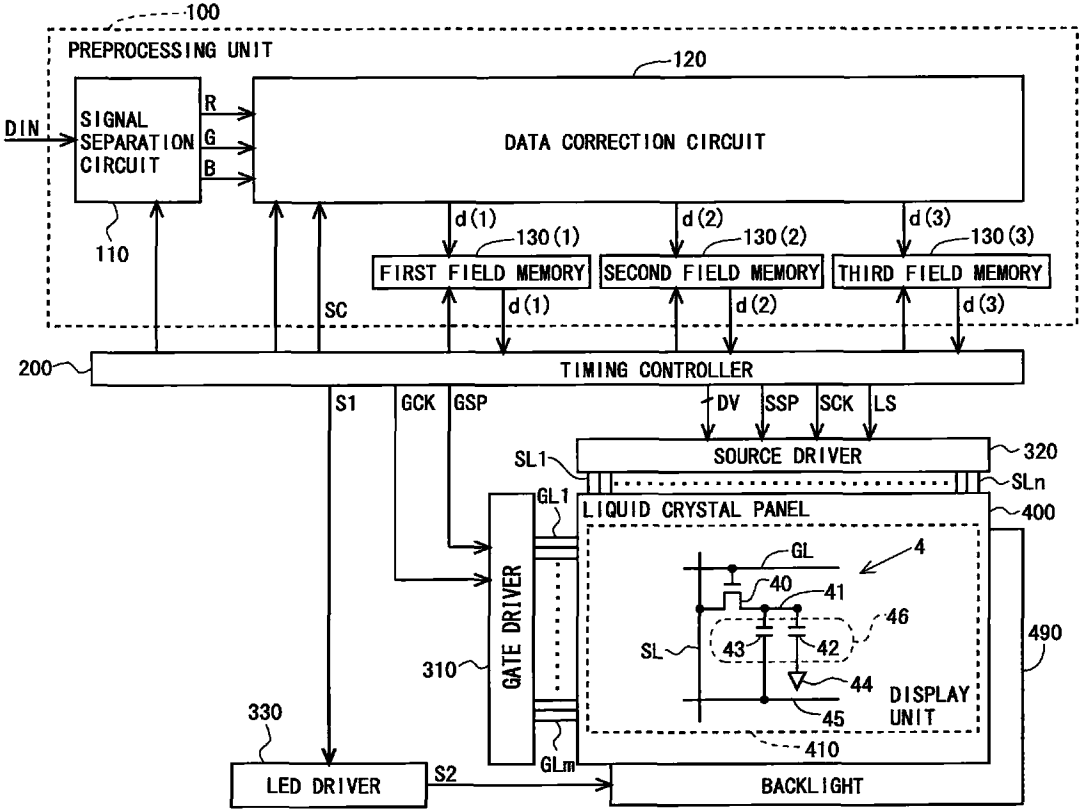
FIG. 9 is a block diagram showing an overall configuration of the liquid crystal display device according to the first embodiment.

FIG. 9 is a block diagram showing an overall configuration of the liquid crystal display device according to the first embodiment of the present invention. The liquid crystal display device includes a preprocessing unit 100, a timing controller 200, a gate driver 310, a source driver 320, an LED driver 330, a liquid crystal panel 400, and a backlight 490. It should be noted that the gate driver 310 or the source driver 320 or both thereof may be provided within the liquid crystal panel 400. The liquid crystal panel 400 includes a display unit 410 for displaying an image. The preprocessing unit 100 includes a signal separation circuit 110, a data correction circuit 120, a first field memory 130(1), a second field memory 130(2), and a third field memory 130(3). In the present embodiment, LEDs (light emitting diodes) are adopted as the light sources of the backlight 490. Specifically, the backlight 490 is constituted by red LEDs, green LEDs, and blue LEDs. It should be noted that, in the present embodiment, a liquid crystal panel driving unit is realized by the timing controller 200, the gate driver 310, and the source driver 320.

Figure 10:
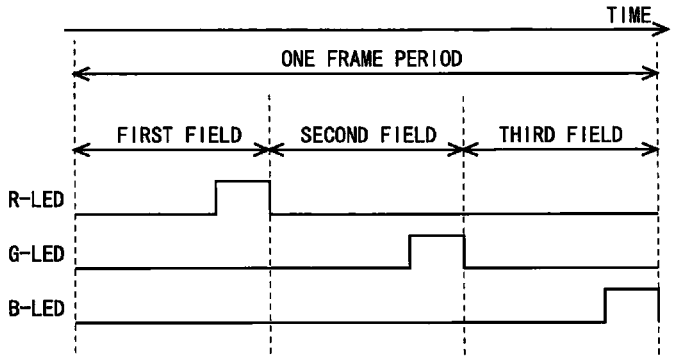
FIG. 10 is a diagram showing a configuration of one frame period in the first embodiment.

The liquid crystal display device according to the present embodiment employs the field sequential system. FIG. 10 is a diagram showing a configuration of one frame period in the present embodiment. In the present embodiment, as lighting patterns, a first lighting pattern in which only the red LEDs are turned on, a second lighting pattern in which only the green LEDs are turned on, and a third lighting pattern in which only the blue LEDs are turned on are prepared. Then, the lighting pattern repeatedly changes in the order of "the first lighting pattern, the second lighting pattern, the third lighting pattern". That is, one frame period is divided into a first field (red field) in which a red screen is displayed based on red components of the input image signal DIN, a second field (green field) in which a green screen is displayed based on green components of the input image signal DIN, and a third field (blue field) in which a blue screen is displayed based on blue components of the input image signal DIN. As understood from FIG. 10, the red LEDs are turned on in a part of the latter half of the first field, the green LEDs are turned on in a part of the latter half of the second field, and the blue LEDs are turned on in a part of the latter half of the third field. During the operation of the liquid crystal display device, these first field, second field, and third field are repeated. Thus, the red screen, the green screen, and the blue screen are repeatedly displayed, and a desired color image is displayed on the display unit 410. It should be noted that the order of the lighting patterns in the frame is not particularly limited. For example, lighting patterns may appear in the order of "the third lighting pattern, the second lighting pattern, the first lighting pattern" (that is, colors may be displayed in the order of "blue, green, red").

Regarding FIG. 9, a plurality of (n-number) source bus lines (video signal lines) SL1 to SLn and a plurality of (m-number) gate bus lines (scanning signal lines) GL1 to GLm are provided in the display unit 410. A pixel formation portion 4 that forms a pixel is provided at each intersection of the source bus lines SL1 to SLn and the gate bus lines GL1 to GLm. That is, the display unit 410 includes a plurality of (n×m-number) pixel formation portions 4. The plurality of pixel formation portions 4 are arranged in a matrix to compose an m-row×n-column pixel matrix. Each pixel formation portion 4 includes a thin film transistor (TFT) 40, which is a switching element in which a gate terminal is connected to the gate bus line GL passing through the corresponding intersection and a source terminal is connected to the source bus line SL passing through the corresponding intersection; a pixel electrode 41 connected to a drain terminal of the TFT 40; a common electrode 44 and an auxiliary capacitance electrode 45 commonly provided for the plurality of pixel formation portions 4; a liquid crystal capacitance 42 formed of the pixel electrode 41 and the common electrode 44; and an auxiliary capacitance 43 formed of the pixel electrode 41 and the auxiliary capacitance electrode 45. A pixel capacitance 46 is configured by the liquid crystal capacitance 42 and the auxiliary capacitance 43. It should be noted that components corresponding to only one pixel formation portion 4 are shown in the display unit 410 in FIG. 9.

Meanwhile, for example, an oxide TFT (a thin film transistor using oxide semiconductor as a channel layer) may be adopted as the TFT 40 in the display unit 410. More specifically, a TFT whose channel layer is formed of In—Ga—Zn—O (indium gallium zinc oxide) that is oxide semiconductor whose main components include indium (In), gallium (Ga), zinc (Zn), and oxygen (O) (such a TFT is hereinafter referred to as "In—Ga—Zn—O-TFT") may be adopted as the TFT 40. By adopting such In—Ga—Zn—O-TFT, in addition to obtaining effects of high definition and low power consumption, writing speed can be increased as compared with the conventional case. Alternatively, a transistor using oxide semiconductor other than In—Ga—Zn—O (indium gallium zinc oxide) as the channel layer may be adopted. The same effects are obtained also when a transistor using oxide semiconductor containing, for example, at least one of indium, gallium, zinc, copper (Cu), silicon (Si), tin (Sn), aluminum (Al), calcium (Ca), germanium (Ge), and lead (Pb) as the channel layer is adopted. It should be noted that use of a TFT other than the oxide TFT is not eliminated in the present invention.

Next, the operation of the components shown in FIG. 9 will be described. The signal separation circuit 110 in the preprocessing unit 100 separates the input image signal DIN sent from the outside into red input gradation data R, green input gradation data G, and blue input gradation data B, and outputs them.

The data correction circuit 120 in the preprocessing unit 100 receives input gradation data (red input gradation data R, green input gradation data G, and blue input gradation data B) outputted from the signal separation circuit 110 and a color order signal SC outputted from the timing controller 200, and performs processing for correcting the data of the order color outside the order color displayable range to the data of the order color inside the order color displayable range so as not to change the hue (color correction processing). Within the data correction circuit 120, first to third digital gradation data, which are digital gradation data for the first to third fields, are generated by this color correction processing. The data correction circuit 120 further performs correction for overdrive on the first to third digital gradation data. Then, the data correction circuit 120 outputs the data obtained as described above as applied gradation data (applied gradation data d(1) to d(3) for the first to third fields). It should be noted that the data correction circuit 120 will be described in more detail later.

In the first to third field memories 130(1) to 130(3), the applied gradation data d(1) to d(3) for the first to third fields outputted from the data correction circuit 120 are stored respectively.

The timing controller 200 reads the applied gradation data d(1) to d(3) for the first to third fields from the first to third field memories 130(1) to 130(3) respectively, and outputs a digital video signal DV; a gate start pulse signal GSP and a gate clock signal GCK which are for controlling the operation of the gate driver 310; a source start pulse signal SSP, a source clock signal SCK, and a latch strobe signal LS which are for controlling the operation of the source driver 320; and an LCD driver control signal S1 which is for controlling the operation of the LED driver 330.

The gate driver 310 repeats application of the active scanning signal to each gate bus line GL with one vertical scanning period as a cycle based on the gate start pulse signal GSP and the gate clock signal GCK which are sent from the timing controller 200.

The source driver 320 receives the digital video signal DV, the source start pulse signal SSP, the source clock signal SCK, and the latch strobe signal LS which are sent from the timing controller 200, and applies the driving video signal to each source bus line SL. At this time, in the source driver 320, the digital video signal DV indicating the voltage to be applied to each source bus line SL is sequentially held at the timing when the pulse of the source clock signal SCK is generated. Then, at the timing when the pulse of the latch strobe signal LS is generated, the held digital video signals DV are converted into analog voltages. The converted analog voltages are simultaneously applied to all source bus lines SL1 to SLn as driving video signals.

The LED driver 330 outputs a light source control signal S2 for controlling the state of each LED constituting the backlight 490 based on the LED driver control signal S1 sent from the timing controller 200. In the backlight 490, switching of the state of each LED (switching between the lighted state and the unlighted state) is performed as appropriate based on the light source control signal S2.

An image corresponding to the input image signal DIN is displayed on the display unit 410 of the liquid crystal panel 400 by applying the scanning signals to the gate bus lines GL1 to GLm, applying the driving video signals to the source bus lines SL1 to SLn, and switching the state of each LED as appropriate, as described above.

<1.2 Data Correction Circuit>

Figure 1:
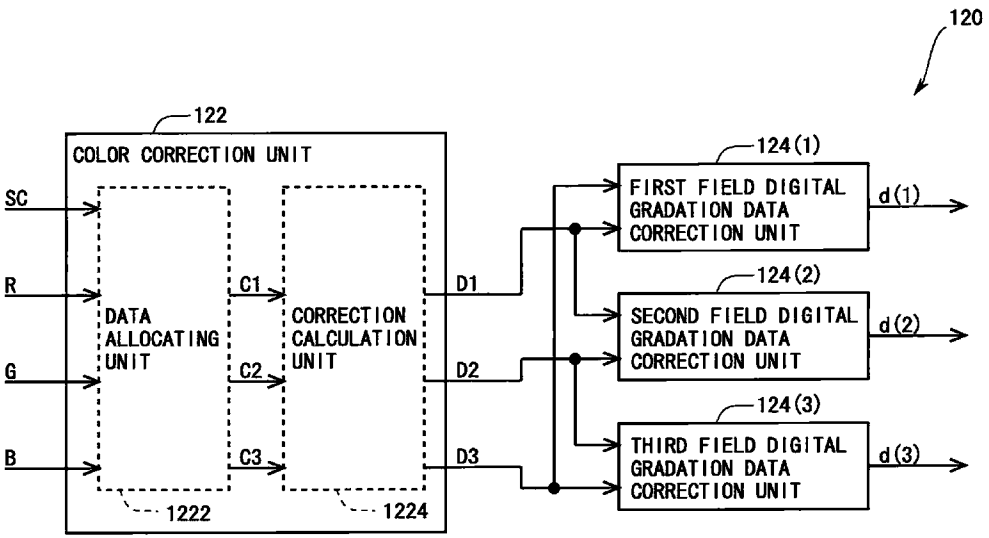
FIG. 1 is a block diagram showing a configuration of a data correction circuit of a liquid crystal display device according to a first embodiment of the present invention.

Next, the configuration and operation of the data correction circuit 120 will be described in detail. FIG. 1 is a block diagram showing a configuration of the data correction circuit 120 in the present embodiment. The data correction circuit 120 includes a color correction unit 122, a first field digital gradation data correction unit 124(1), a second field digital gradation data correction unit 124(2), and a third field digital gradation data correction unit 124(3). The color correction unit 122 includes a data allocating unit 1222 and a correction calculation unit 1224. It should be noted that, in the following description, the first to third field digital gradation data correction units 124(1) to 124(3) are collectively referred to simply as "digital gradation data correction unit". The digital gradation data correction unit is denoted by reference character 124.

<1.2.1 Color Correction Unit>

To the data allocating unit 1222 in the color correction unit 122, the color order signal SC outputted from the timing controller 200 and the input gradation data (red input gradation data R, green input gradation data G, and blue input gradation data B) are inputted. The color order signal SC is a signal indicating the display order of colors in the frame. In the present embodiment, the color order signal SC indicates that the display order of the colors in the frame is "red, green, blue". The data allocating unit 1222 allocates the input gradation data (red input gradation data R, green input gradation data G, and blue input gradation data B) to three fields according to the color order signal SC. In the present embodiment, the red input gradation data R is allocated to the first field, the green input gradation data G is allocated to the second field, and the blue input gradation data R is allocated to the third field. That is, from the data allocating unit 1222, the data value of the red input gradation data R is outputted as the first field value C1, the data value of the green input gradation data G is outputted as the second field value C2, and the data value of the blue input gradation data B is outputted as the third field value C3.

The correction calculation unit 1224 in the color correction unit 122 includes a calculation circuit. The correction calculation unit 1224 performs color correction processing (calculation processing using the calculation circuit) on the first to third field values C1 to C3 outputted from the data allocating unit 1222, and outputs data after correction as first to third digital gradation data D1 to D3. By the way, in the data allocating unit 1222, allocation of the input gradation data to the fields is performed according to the display order of colors in the frame. Then, the correction calculation unit 1224 performs calculation processing based on the data of order that is data obtained by allocating the input gradation data (data of a plurality of colors) to the fields without considering colors in the frame.

Figure 11:
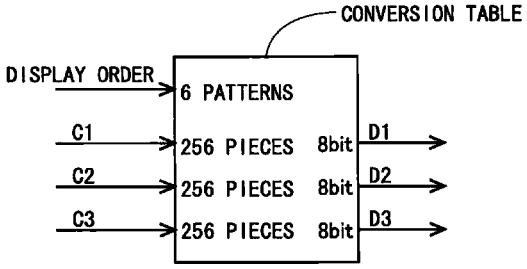
FIG. 11 is a diagram for explaining correction of data using the conversion table.

Here, the color correction processing in the present embodiment will be described in detail. As described above, in the liquid crystal display device according to the present invention, by changing the saturation while maintaining the hue, the processing of correcting the image data outside the order color displayable range to the image data inside the order color displayable range is performed. As a method of performing such a processing, a method is considered in which a conversion table associating data before correction (data corresponding to the first to third field values C1 to C3) with data after correction (data corresponding to first to third digital gradation data D1 to D3) is prepared for each display order and data is corrected using the conversion table (see FIG. 11). In the case of displaying the primary colors one by one as in the present embodiment, the number of display order is six. Moreover, each field value can take 256 values. Therefore, according to the method using the conversion table, (6×256×256×256) addresses are required. Since each field value is 8 bit data, 24 bits are required to store one data after correction. Accordingly, a memory capacity of (6×256×256×256)×24 bits, that is, about 23 gigabit is required. However, it is not realistic to have such an enormous memory capacity. Therefore, in the present embodiment, occurrence of color shift is suppressed without providing an enormous huge memory capacity by performing color correction processing to be described below.

Figure 12:
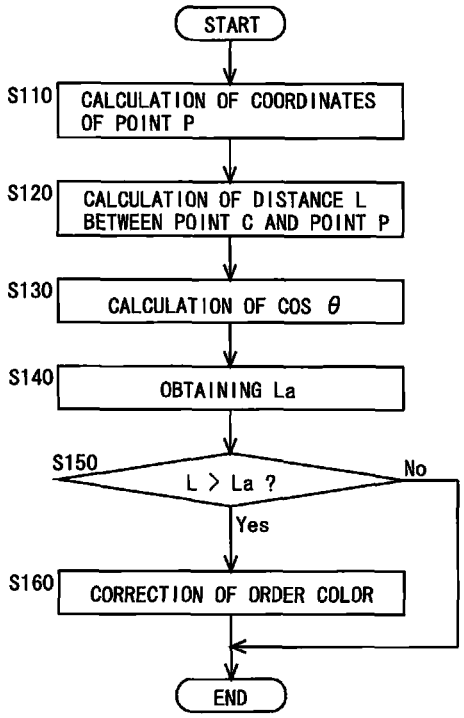
FIG. 12 is a flowchart showing a detailed procedure of the color correction processing performed by the correction calculation unit in the first embodiment.

FIG. 12 is a flowchart showing a detailed procedure of the color correction processing performed by the correction calculation unit 1224 in the present embodiment. It should be noted that, it is assumed that a point representing the order color focused here is represented by C and the coordinates of the point C are (C1, C2, C3) in the display order color space (see FIG. 13).

After starting the color correction processing, first, a plane including the point C and having the pseudo achromatic axis 52 as a normal is assumed, and the coordinates of the point P representing the achromatic color on the plane are obtained (step S110). Since the point P is a point representing the achromatic color, the values of the c1 axis, the c2 axis, and the c3 axis are all equal. That is, the coordinates of the point P are represented by (m, m, m) (m is an integer from 0 to 255 in the present embodiment). Further, the point P is a point which has the shortest distance from the point C, among the points on the pseudo achromatic axis 52. From the above, the value of m is calculated by the following equation (1).

[Expression 1]

$$m = \frac{C1 + C2 + C3}{3} \tag{1}$$

Next, the distance L between the point C and the point P is calculated (step S120). When assuming that the distance between the original point O and the point P is represented by M, and the distance between the original point O and the point C is represented by N, the following equation (2) is established from the Pythagorean theorem.

[Expression 2]

$$L=\sqrt{N^2-M^2} \tag{2}$$

Also, since the coordinates of the original point O are (0, 0, 0), the distance M between the original point O and the point P is represented by the following equation (3), and the distance N between the original point O and the point C is represented by the following equation (4).

[Expression 3]

$$M=\sqrt{m^2+m^2+m^2} \tag{3}$$

[Expression 4]

$$N=\sqrt{C1^2C2^2+C3^2} \tag{4}$$

Based on the above equations (1) to (4), the distance L between the point C and the point P is represented by the following equation (5).

[Expression 5]

$$L = \sqrt{C1^2 + C2^2 + C3^2 - \frac{(C1 + C2 + C3)^2}{3}} \tag{5}$$

Next, cos θ is calculated where θ is an angle between the straight line obtained by projecting the c1 axis on the plane having the pseudo achromatic axis 52 as a normal (the line indicated by reference character 53 in FIG. 13 and FIG. 14) and the line segment PC (step S130). It should be noted that FIG. 14 is a top view of the plane including the point C and having the pseudo achromatic axis 52 as a normal. Here, when assuming that a vector parallel to the line segment PC with the original point O as a starting point is represented by vector a and a unit vector extending in the direction of the c1 axis from the original point O is represented by vector b, the θ is equal to the angle between the vector a and the vector b as understood from FIG. 15. By the way, when the outer product of the vector a and the vector having the point P as the start point and the point C as the end point is 0, the vector a and the line segment PC are parallel. When the vector a is represented by (F, S, T), the above outer product is 0 and the vector a and the line segment PC are parallel in a case in which the (F, S, T) is expressed by the following equation (6).

[Expression 6]

$$\begin{bmatrix} F \\ S \\ T \end{bmatrix} = \begin{bmatrix} -2 & 1 & 1 \\ 1 & -2 & 1 \\ 1 & 1 & -2 \end{bmatrix} \begin{bmatrix} C1 \\ C2 \\ C3 \end{bmatrix} \tag{6}$$

The vector b is represented by (1, 0, 0). Further, since the following equation (7) is established, cos θ is represented by the following equation (8).

[Expression 7]

$$\vec{a} \cdot \vec{b} = a \cdot b \cdot \cos\theta = F \tag{7}$$

[Expression 8]

$$\begin{aligned} \cos\theta &= \frac{F}{a \times b} \\ &= \frac{F}{\sqrt{F^2 + S^2 + T^2} \times 1} \\ &= \frac{F}{\sqrt{F^2 + S^2 + T^2}} \end{aligned} \tag{8}$$

In step S130, cos θ is calculated as described above.

In the present embodiment, the maximum distances (the maximum distances from the achromatic point) La (see FIG. 13) at which the order color is a color inside the order color displayable range are held in advance such that each of the maximum distances corresponds to a combination of m and cos θ. That is, a table as shown in FIG. 16 (hereinafter referred to as "displayable range table") is held in the correction calculation unit 1224. Under such a condition, the value of La is obtained by referring to the displayable range table based on the value of m calculated by step S110 and the value of cos θ calculated by step S130 (step S140).

Thereafter, it is determined whether or not the value of L is larger than the value of La (step S150). As a result, when the value of L is less than or equal to the value of La, data correction (correction of order color) is not performed. That is, the first to third field values C1 to C3 are outputted as they are as the first to third digital gradation data D1 to D3 from the correction calculation unit 1224. On the other hand, when the value of L is larger than the value of La, the color corresponding to the point D located at the distance La from the point P toward the point C in the display order color space is set as the order color after correction (step S160). That is, the coordinates (D1, D2, D3) of the point D are calculated, and the calculated data values are outputted from the correction calculation unit 1224 as the first to third digital gradation data D1 to D3. It should be noted that the coordinates (D1, D2, D3) of the point D are represented by the following equation (9) by using vectors.

[Expression 9]

$$(D1, D2, D3) = \vec{O}P + \frac{La}{L} \times \vec{P}C \tag{9}$$

The coordinates (D1, D2, D3) of the point D are calculated by substituting values on the right side of the above equation (9).

As described above, correcting image data outside the order color displayable range to image data inside the order color displayable range is performed so as not to change the hue.

<1.2.2 Digital Gradation Data Correction Unit>

Next, the digital gradation data correction unit will be described in detail. The first field digital gradation data correction unit 124(1) receives the third digital gradation data D3 and the first digital gradation data D1, and performs correction for overdrive on the first digital gradation data D1 depending on the data value (gradation value) of the third digital gradation data D3. The second field digital gradation data correction unit 124(2) receives the first digital gradation data D1 and the second digital gradation data D2, and performs correction for overdrive on the second digital gradation data D2 depending on the data value (gradation value) of the first digital gradation data D1. The third field digital gradation data correction unit 124(3) receives the second digital gradation data D2 and the third digital gradation data D3, and performs correction for overdrive on the third digital gradation data D3 depending on the data value (gradation value) of the second digital gradation data D2. Hereinafter, how to perform correction for overdrive will be described in detail focusing on any one order color.

FIG. 17 is a diagram for explaining the digital gradation data correction unit 124. The digital gradation data correction unit 124 includes a gradation value conversion look-up table 125 as described below. To the digital gradation data correction unit 124, digital gradation data Qa of the preceding field and digital gradation data Qb of the display field (current field) are inputted. It should be noted that, in the following description, the data value (gradation value) of the digital gradation data Qa of the preceding field is referred to as "preceding field value", and the data value (gradation value) of the digital gradation data Qb of the display field is referred to as "display field value". The digital gradation data correction unit 124 obtains an output value corresponding to a combination of the preceding field value and the display field value based on the gradation value conversion look-up table 125. The output value obtained based on the gradation value conversion look-up table 125 is outputted from the digital gradation data correction unit 124 as digital gradation data Q'.

Figures 18, 19:
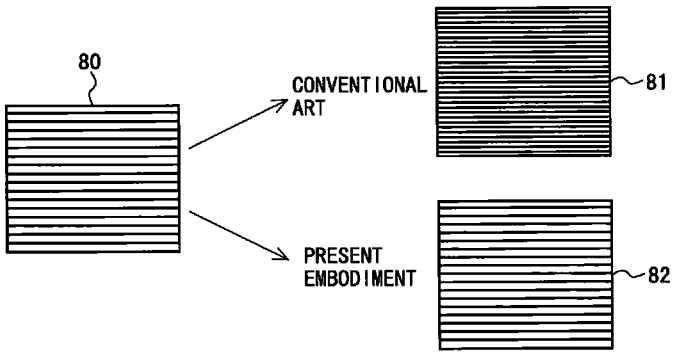
FIG. 18 is a diagram showing an example of a gradation value conversion look-up table in the first embodiment.
FIG. 19 is a diagram for explaining an effect in the first embodiment.

FIG. 18 is a diagram showing an example of the gradation value conversion look-up table 125. In FIG. 18, each of the numerical values written in the leftmost column indicates the preceding field value, and each of the numerical values written in the uppermost row indicates the display field value. Also, each of the numerical values written at the position where each row and each column intersect indicates the gradation value (output value) corresponding to the drive voltage determined based on the combination of the preceding field value and the display field value. For example, when the preceding field value is "128" and the display field value is "192", the output value is "210". Also, for example, when the preceding field value is "128" and the display field value is "32", the output value is "25". In this manner, the output values in the gradation value conversion look-up table 125 are defined so that correction for enhancing the temporal change of the data value is performed on the digital gradation data. It should be noted that the values stored in the gradation value conversion look-up table 125 are in accordance with the previously measured response characteristics of the adopted liquid crystal panel.

Incidentally, in the gradation value conversion look-up table 125 shown in FIG. 18, only 9 gradation values out of 256 gradation values are stored as preceding field values and display field values. That is, only values corresponding to combinations of some gradation values out of all gradation values that the liquid crystal panel 400 can represent are stored as output values in the gradation value conversion look-up table 125. Therefore, for example, when the preceding field value is "48" and the display field value is "140", the output value can not be directly obtained from the gradation value conversion look-up table 125. In such a case, the output value when the preceding field value is "48" and the display field value is "140" is determined by the interpolation calculation based on the output value when the preceding field value is "32" and the display field value is "128", the output value when the preceding field value is "32" and the display field value is "160", the output value when the preceding field value is "64" and the display field value is "128", and the output value when the preceding field value is "69 64" and the display field value is "160".

It should be noted that, if an increase in memory capacity is permitted, then the configuration may be such that ail of the gradation values that can be expressed by the liquid crystal panel 400 are stored in the gradation value conversion look-up table 125 as preceding field values and display field values. According to this configuration, although the capacity of the memory to be mounted on the liquid crystal display device increases, occurrence of color shift is more effectively suppressed since error due to the interpolation calculation does not occur.

<1.3 Effects>

According to the present embodiment, in the liquid crystal display device employing the field sequential system, data of a color that can not be displayed is corrected to data of a displayable color by lowering the saturation without changing the hue. At that time, the color in which the variation amount for the saturation is the smallest among the displayable colors is taken as the color after correction. In this manner, since the correction is performed so that the hue does not change and the variation amount for the saturation is as small as possible, occurrence of a large color shift is suppressed when the color image is displayed. It should be noted that, by adopting an oxide TFT as the TFT 40 in the display unit 410, in addition to obtaining effects of high definition and low power consumption, writing speed can be increased as compared with the conventional case. As a result, occurrence of color shift is more effectively suppressed. Further, in the present embodiment, since the overdrive is performed, the displayable range is wider than when the overdrive is not performed. Accordingly, it is possible to make the color after correction closer to the color before correction.

From the above, schematically, for example, in a case in which displaying of a color indicated by reference character 80 in FIG. 19 is to be performed, although displaying of a color indicated by reference character 81 in FIG. 19 is performed in the conventional art, displaying of a color indicated by reference character 82 in FIG. 19 is performed in the present embodiment. In this manner, according to the present embodiment, occurrence of color shift is greatly suppressed as compared with the conventional art. That is, a liquid crystal display device employing the field sequential system and capable of suppressing occurrence of color shift is realized.

Further, according to the present embodiment, before performing the color correction processing, allocating data of three colors (red input gradation data R, green input gradation data G, and blue input gradation data B) to three fields (first to third fields) is performed. Then, in the correction calculation unit 1224 (see FIG. 1), calculation processing is performed based on the order data obtained by this allocation. That is, in the correction calculation unit 1224, calculation processing is performed without considering colors in the frame. Since such a configuration is adopted, it is possible to simplify the calculation circuit in the correction calculation unit 1224. As a result, an effect of cost reduction due to reduction in circuit scale can be obtained.

<1.4 Modifications>

<1.4.1 First Modification>

Figure 20:
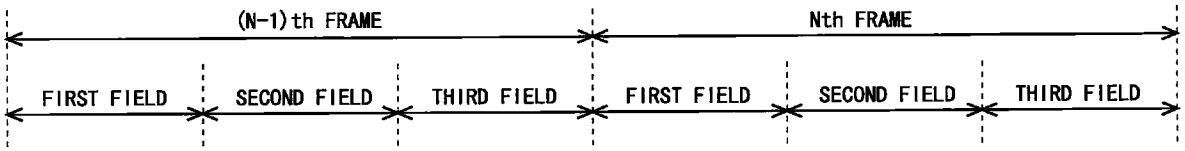
FIG. 20 is a diagram for explaining overdrive.

In the first embodiment, correction for overdrive is performed based on gradation values of two fields included in the same frame in the digital gradation data correction unit 124. Therefore, as for the gradation value of the red field which is the first field of the frame, correction for overdrive is performed depending on the gradation value of the blue field which is the third field of the current frame. When the still image display is performed, there is no problem even with such a configuration. However, when the moving image display is performed, since the gradation value of each field varies frame by frame, the desired effect due to the overdrive can not be obtained in a case in which the above configuration is adopted. This is because, in order to perform correction for the overdrive on the gradation value of the first field of a certain frame (the Nth frame in FIG. 20), it is necessary to compare the gradation value of the first field of the frame with the gradation value of the third field of the preceding frame (the (N−1)th frame in FIG. 20), as can be understood from FIG. 20. Accordingly, in the present embodiment, the data correction circuit 120 is configured to be able to compare the gradation value of the first field of each frame with the gradation value of the last field of the preceding frame.

Figure 21:
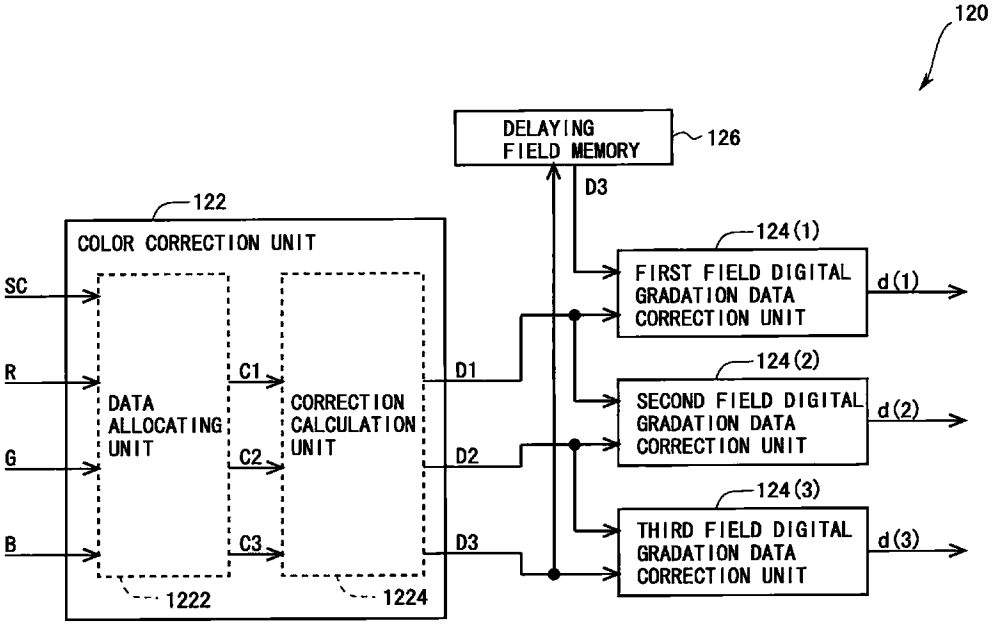
FIG. 21 is a block diagram showing a configuration of a data correction circuit in a first modification of the first embodiment.

FIG. 21 is a block diagram showing a configuration of the data correction circuit 120 in the present modification. The data correction circuit 120 in the present modification is provided with a delaying field memory 126 in addition to the components in the first embodiment (see FIG. 1). In the delaying field memory 126, the third digital gradation data D3 outputted from the color correction unit 122 is stored. The third digital gradation data D3 stored in the delaying field memory 126 is maintained for one frame period. Since such a delaying field memory 126 is provided in the data correction circuit 120, the first field digital gradation data correction unit 124(1) can compare the gradation value of the first field of the current frame with the gradation value of the third field of the preceding frame. That is, the first field digital gradation data correction unit 124(1) in the present modification performs correction for the overdrive on the first digital gradation data D1 outputted from the color correction unit 122 depending on the gradation value of the third field of the preceding frame.

According to the present modification, when correction for the overdrive is performed on the data of the first field of each frame, it is possible to compare the gradation value of the first field of the target frame and the gradation value of the last field of the preceding frame. Thus, when moving image display is performed, correction for overdrive can be effectively performed also on the data of the first field of each frame. As a result, occurrence of color shift is suppressed even when moving image display is performed in the liquid crystal display device employing the field sequential system.

<1.4.2 Second Modification>

In the liquid crystal display device employing the field sequential system, one frame period is typically divided into three fields, as described above. Then, images of different colors are displayed in the three fields. The images of the three fields are superimposed on the observer's retina by the image lag phenomenon, whereby the image for one frame is perceived by the observer. In such a liquid crystal display device employing the field sequential system, lighting state of the light source (backlight) varies every field. In the case of the first embodiment, only the red LEDs are turned on in the first field, only the green LEDs are turned on in the second field, and only the blue LEDs are turned on in the third field. Since the lighting state of the light source varies every field in this manner, the drive frequency of the entire light source is 180 Hz when the frame frequency is 60 Hz in the liquid crystal display device in which one frame period is divided into three fields. However, when paying attention to the light source of only one color, the drive frequency of the light source of the target color is 60 Hz. Generally, it is known that a change in the lighting state is perceived by the observer as flicker when the lighting state of the light source is controlled with a driving frequency of less than 70 Hz. Although the luminance of the light source is constant in the liquid crystal display device employing the color filter system, the luminance change depending on the driving frequency of the light source of each color (monochromatic light source) occurs in the liquid crystal display device employing the field sequential system. Since luminance change occurs at a frequency of 60 Hz for each color in this manner, flicker is perceived by human eyes. Therefore, in the liquid crystal display device according to the present modification, the occurrence of flicker is suppressed by increasing the frequency of luminance change by the configuration described below.

Figure 22:
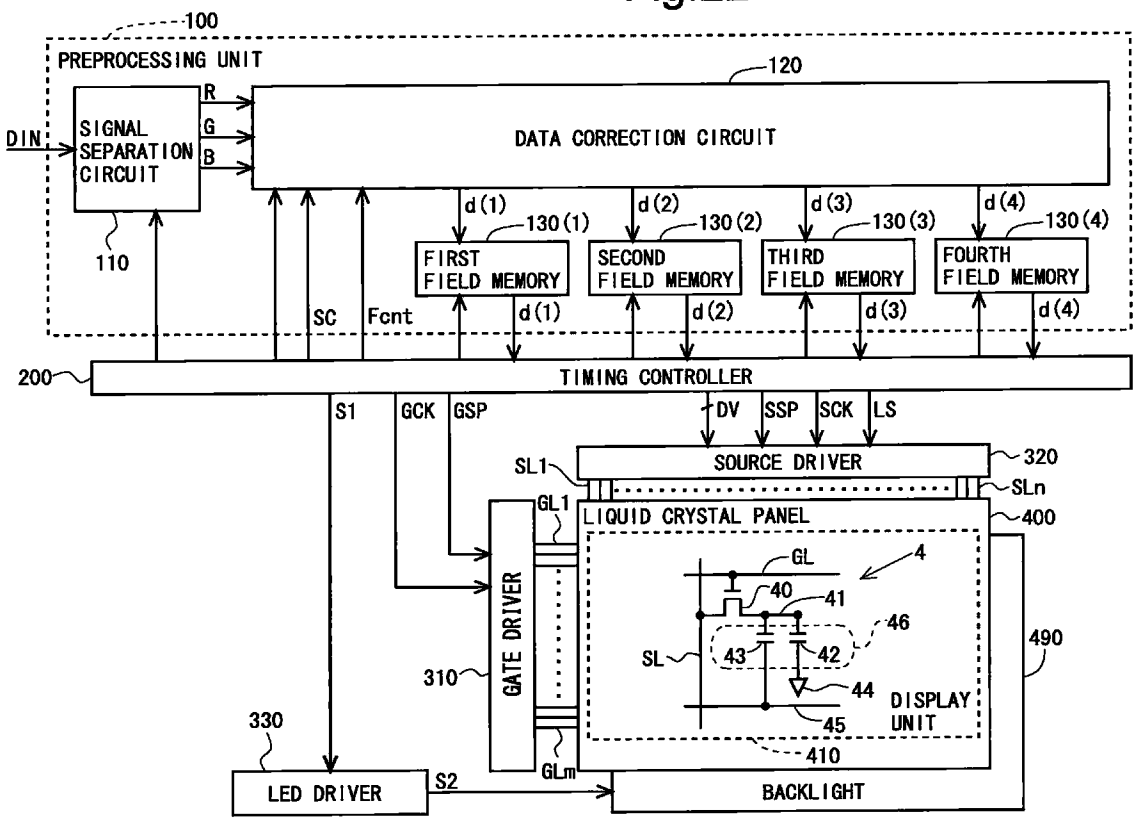
FIG. 22 is a block diagram showing an overall configuration of a liquid crystal display device in a second modification of the first embodiment.

FIG. 22 is a block diagram showing an overall configuration of the liquid crystal display device according to the present modification. In the present modification, in addition to the components in the first embodiment (see FIG. 9), the fourth field memory 130(4) is provided in the preprocessing unit 100. Then, one frame period is divided into four fields (first to fourth fields). Regarding the lighting patterns, three lighting patterns (first to third lighting patterns) similar to those of the first embodiment are prepared. That is, one frame period is divided into a plurality of fields, the number of the fields is larger than the number of lighting patterns. Further, in the present modification, a frame count signal Fcnt for changing the output order of data of colors (primary colors) depending on the frame is given to the data correction circuit 120 in the preprocessing unit 100 from the timing controller 200.

Figure 23:
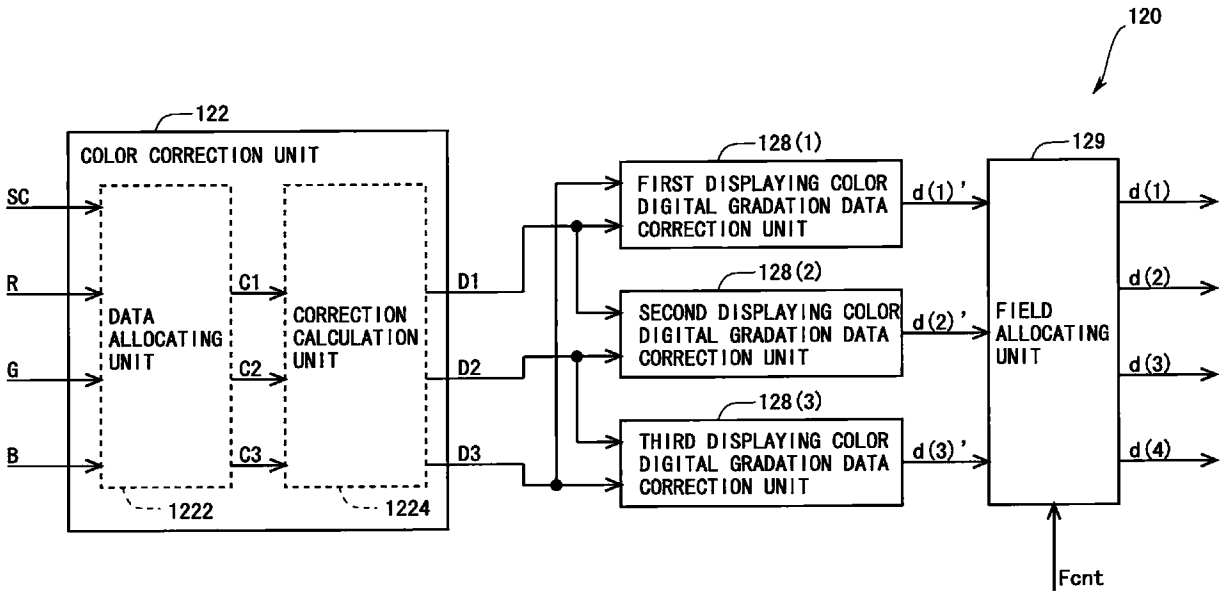
FIG. 23 is a block diagram showing a configuration of a data correction circuit in the second modification of the first embodiment.

FIG. 23 is a block diagram showing a configuration of the data correction circuit 120 in the present modification. In this data correction circuit 120, a field allocating unit 129 is provided in addition to the components in the first embodiment (see FIG. 1). Further, the first to third displaying color digital gradation data correction units 128(1) to 128(3) are provided instead of the first to third field digital gradation data correction units 124(1) to 124(3) in the first embodiment. However, the first to third displaying color digital gradation data correction units 128(1) to 128(3) operate similar to the first to third field digital gradation data correction units 124(1) to 124(3), respectively.

In the present modification, the applied gradation data d(1)' generated based on the red input gradation data R is outputted from the first displaying color digital gradation data correction unit 128(1), the applied gradation data d(2)' generated based on the green input gradation data G is outputted from the second displaying color digital gradation data correction unit 128(2), and the applied gradation data d(3)' generated based on the blue input gradation data B is outputted from the third displaying color digital gradation data correction unit 128(3).

The field allocating unit 129 allocates the applied gradation data d(1)' to d(3)' to the four fields depending on the frame count signal Fcnt. It should be noted that "0", "1", and "2" are sequentially repeated for the data value of the frame count signal Fcnt. The data value of the frame count signal Fcnt changes at the timing when the frame is switched. Specifically, the data value of the frame count signal Fcnt is 0 in the frame in which lighting patterns appear in the order of "the third lighting pattern, the second lighting pattern, the first lighting pattern, the third lighting pattern", the data value of the frame count signal Fcnt is 1 in the frame in which lighting patterns appear in the order of "the second lighting pattern, the first lighting pattern, the third lighting pattern, the second lighting pattern", and the data value of the frame count signal Fcnt is 2 in the frame in which lighting patterns appear in the order of "the first lighting pattern, the third lighting pattern, the second lighting pattern, the first lighting pattern".

Figure 24:
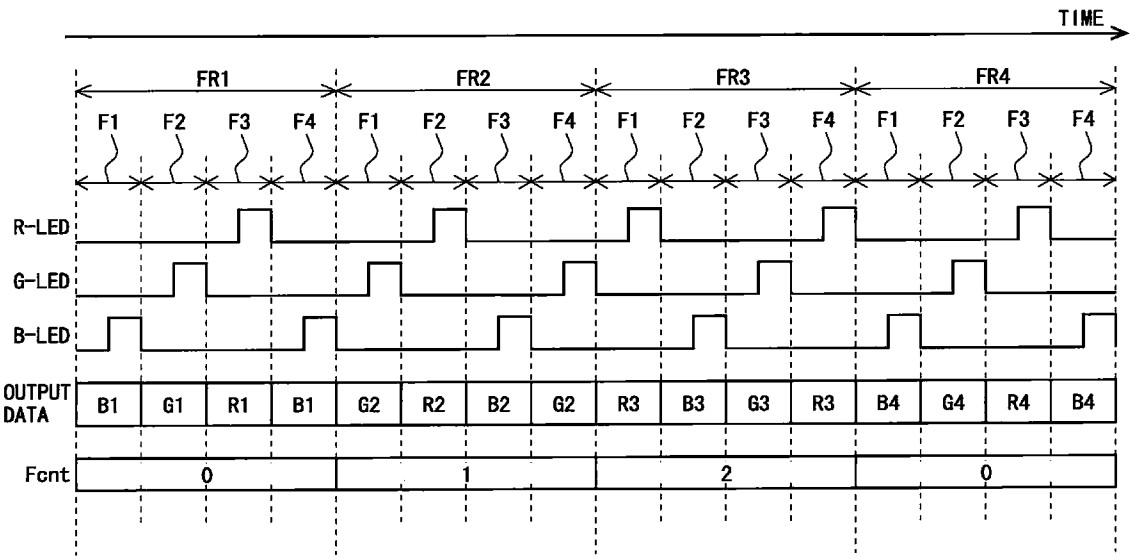
FIG. 24 is a diagram for explaining the operation of the field allocating unit in the second modification of the first embodiment.

With reference to FIG. 24, the operation of the field allocating unit 129 will be further described. It should be noted that, in FIG. 24, the first to fourth frames are denoted by reference characters FR1 to FR4 with reference to a certain frame, and the first to fourth fields of each frame are denoted by reference characters F1 to F4. Further, regarding the column of output data, "Rj" represents data based on the red input gradation data R of the jth frame, "Gj" represents data based on the green input gradation data G of the jth frame, and "Bj" represents data based on the blue input gradation data B of the jth frame.

When the data value of the frame count signal Fcnt is 0, the field allocating unit 129 allocates the applied gradation data d(1)' to d(3)' to the four fields (first to fourth fields F1 to F4) as follows.

First field F1: the applied gradation data d(3)', namely data based on the blue input gradation data B Second field F2: the applied gradation data d(2)', namely data based on the green input gradation data G Third field F3: the applied gradation data d(1)', namely data based on the red input gradation data R Fourth field F4: the applied gradation data d(3)', namely data based on the blue input gradation data B When the data value of the frame count signal Fcnt is 1, the field allocating unit 129 allocates the applied gradation data d(1)' to d(3)' to the four fields (first to fourth fields F1 to F4) as follows.

First field F1: the applied gradation data d(2)', namely data based on the green input gradation data G Second field F2: the applied gradation data d(1)', namely data based on the red input gradation data R Third field F3: the applied gradation data d(3)', namely data based on the blue input gradation data B Fourth field F4: the applied gradation data d(2)', namely data based on the green input gradation data G When the data value of the frame count signal Fcnt is 2, the field allocating unit 129 allocates the applied gradation data d(1)' to d(3)' to the four fields (first to fourth fields F1 to F4) as follows.

First field F1: the applied gradation data d(1)', namely data based on the red input gradation data R Second field F2: the applied gradation data d(3)', namely data based on the blue input gradation data B Third field F3: the applied gradation data d(2)', namely data based on the green input gradation data G Fourth field F4: the applied gradation data d(1)', namely data based on the red input gradation data R In the present modification, the allocation of data as described above is repeated with three frames as a cycle. Here, since the frame frequency in the present modification is 60 Hz and one frame period is divided into four fields, the drive frequency of the entire light source is 240 Hz. Further, although one frame period is divided into four fields, screens of the same color are displayed every three fields since allocation of data is performed as described above. Thus, the frequency of the luminance change is 80 Hz.

From the above, according to the present modification, the display is performed at the refresh rate (update frequency) of 80 Hz, apparently. As a result, occurrence of flicker is suppressed. Accordingly, a liquid crystal display device employing the field sequential system and capable of suppressing occurrence of color shift and occurrence of flicker is realized.

2. Second Embodiment

<2.1 Configuration and the like>

The overall configuration, the configuration of the data correction circuit, and the configuration of one frame period are the same as those in the first embodiment, and therefore the description thereof is omitted (see FIG. 9, FIG. 1, and FIG. 10). The contents of the color correction processing are different between the present embodiment and the first embodiment. Therefore, hereinafter, the color correction processing in the present embodiment will be described.

<2.2 Color Correction Processing>

Figures 25, 26:
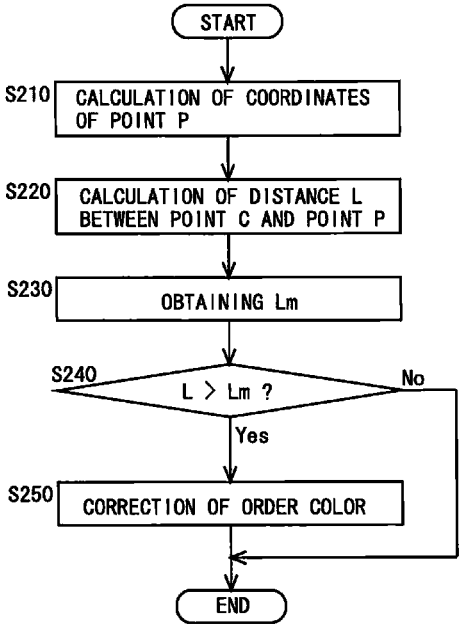
FIG. 25 is a flowchart showing a detailed procedure of the color correction processing performed by the correction calculation unit in the second embodiment of the present invention.
FIG. 26 is a schematic diagram of a displayable range table in the second embodiment.

FIG. 25 is a flowchart showing a detailed procedure of the color correction processing performed by the correction calculation unit 1224 in the present embodiment. In step S210 and step S220, the same processings as step S110 and step S120 in the first embodiment (see FIG. 12) are performed.

Figure 13:
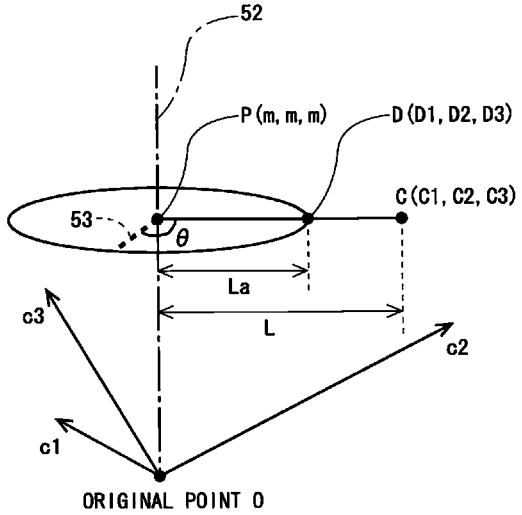
FIG. 13 is a diagram for explaining the color correction processing in the first embodiment.
Figure 14:
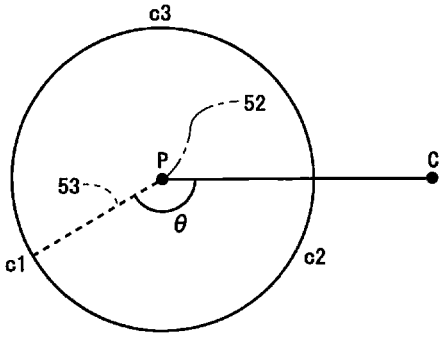
FIG. 14 is a diagram for explaining the color correction processing in the first embodiment.

Meanwhile, in the first embodiment, in the displayable range table, the maximum distances La are held so as to correspond to the combination of m and cos θ (see FIG. 13 and FIG. 16). If 256 values of cos θ are to be held, a memory capacity to hold (256×256) values of La is required. Therefore, in the present embodiment, in order to reduce the memory capacity, the distance Lm from the achromatic point P to the point corresponding to the order color after correction is determined only depending on the value of m without depending on the value of cos θ. That is, in the displayable range table in the present embodiment, the correspondence relationship between m and the distance Lm is held as shown in FIG. 26. Under such a condition, the value of Lm is obtained by referring to the displayable range table based on the value of m calculated by step S210 (step S230).

Figure 27:
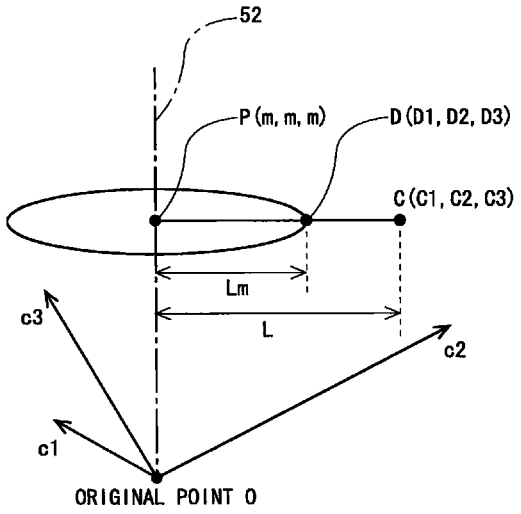
FIG. 27 is a diagram for explaining the color correction processing in the second embodiment.
Figure 28:
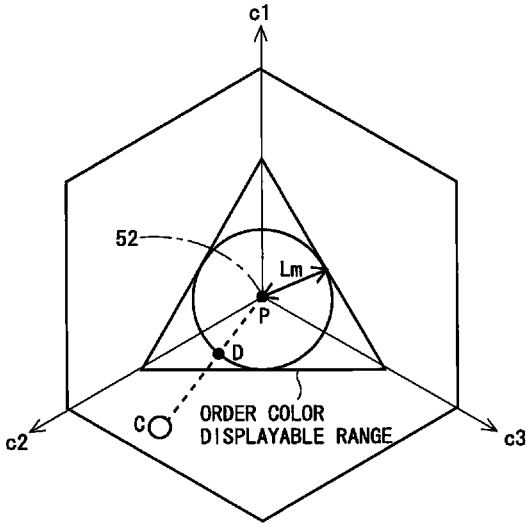
FIG. 28 is a diagram for explaining the color correction processing in the second embodiment.

Thereafter, it is determined whether or not the value of L is larger than the value of Lm (step S240). As a result, when the value of L is less than or equal to the value of Lm, data correction (correction of order color) is not performed. That is, the first to third field values C1 to C3 are outputted as they are as the first to third digital gradation data D1 to D3 from the correction calculation unit 1224. On the other hand, when the value of L is larger than the value of Lm, the color corresponding to the point D located at the distance Lm from the point P toward the point C in the display order color space is set as the order color after correction (step S250) (see FIG. 27 and FIG. 28). That is, the coordinates (D1, D2, D3) of the point D are calculated, and the calculated data values are outputted from the correction calculation unit 1224 as the first to third digital gradation data D1 to D3. It should be noted that the coordinates (D1, D2, D3) of the point D are represented by the following equation (10) by using vectors.

[Expression 10]

$$(D1, D2, D3) = \vec{OP} + \frac{Lm}{L} \times \vec{PC} = \frac{1}{3 \times L} \times \begin{bmatrix} 2Lm + L & -Lm + L & -Lm + L \\ -Lm + L & 2Lm + L & -Lm + L \\ -Lm + L & -Lm + L & 2Lm + L \end{bmatrix} \begin{bmatrix} C1 \\ C2 \\ C3 \end{bmatrix} \quad (10)$$

As described above, correcting image data outside the order color displayable range to image data inside the order color displayable range is performed so as not to change the hue.

<2.3 Effects>

According to the present embodiment, a liquid crystal display device employing the field sequential system and capable of suppressing the occurrence of color shift can be realized with a smaller memory capacity than the first embodiment.

3. Third Embodiment

<3.1 Configuration and the like>

The overall configuration, the configuration of the data correction circuit, and the configuration of one frame period are the same as those in the first embodiment, and therefore the description thereof is omitted (see FIG. 9, FIG. 1, and FIG. 10). The contents of the color correction processing are different between the present embodiment and the first embodiment. Therefore, hereinafter, the color correction processing in the present embodiment will be described.

<3.2 Color Correction Processing>

In the first embodiment, when the value of L is larger than the value of La, the color corresponding to the point D located at the distance La from the point P toward the point C in the display order color space is set as the order color after correction (see FIG. 13) regardless of the magnitude of the value of L. In this case, regarding each combination of m and cos θ, the order colors where the distance from the pseudo achromatic axis 52 is larger than or equal to La (namely, the order colors having the saturation more than or equal to a certain degree) are all corrected to the same color. Thus, regarding the color having the high saturation, desired gradation display is not performed. Therefore, in the present embodiment, the order color after correction is determined based on a value obtained by normalizing the value of L with the maximum value Lmax that L can take and a value obtained from the displayable range table similar to the first embodiment depending on the combination of m and cos θ (a value of La). Hereinafter, this will be described in detail with reference to FIG. 29.

When assuming that the point representing any focused order color is represented by C, first, the values of m, L, and cos θ are obtained in the same manner as in the first embodiment. A displayable range table similar to that of the first embodiment is provided in the present embodiment, and the value of La is obtained based on the value of m and the value of cos θ. A point corresponding to the order color where the distance from the pseudo achromatic axis 52 is Lmax in the display order color space is one of a point on the plane formed by the c1 axis and the c2 axis, a point on the plane formed by the c2 axis and the c3 axis, and a point on the plane formed by the c3 axis and the c1 axis. Here, when assuming that a point corresponding to the order color after correction is D and a distance between the point P and the point D is Lo, the coordinates of the point D are determined such that "Lmax:L=La:Lo" is established. From the above, in the present embodiment, the correction is performed also on the data of the order color inside the order color displayable range such that the gradation display is performed also regarding the color having the high saturation.

Figure 30:
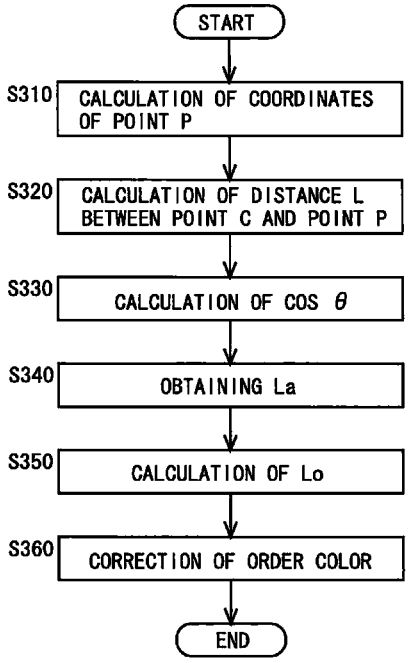
FIG. 30 is a flowchart showing a detailed procedure of the color correction processing performed by the color correction unit in the third embodiment of the present invention.

FIG. 30 is a flowchart showing a detailed procedure of the color correction processing performed by the correction calculation unit 1224 in the present embodiment. In step S310, step S320, step S330, and step S340, the same processings as step S110, step S120, step S130, and step S140 in the first embodiment (see FIG. 12) are performed.

Next, the distance Lo (see FIG. 29) between the point P and the point D is calculated (step S350). As described above, the coordinates of the point D are obtained such that "Lmax:L=La:Lo" is established in the present embodiment. That is, Lo is calculated by the following equation (11).

[Expression 11]

$$Lo = La \times \frac{L}{L_{max}} \tag{11}$$

Then, the color corresponding to the point D located at the distance Lo from the point P toward the point C in the display order color space is set as the order color after correction (step S360). That is, the coordinates (D1, D2, D3) of the point D are calculated, and the calculated values are outputted as the first to third digital gradation data D1 to D3 from the correction calculation unit 1224. It should be noted that the coordinates (D1, D2, D3) of the point D are represented by the following equation (12) by using vectors.

[Expression 12]

$$(D1, D2, D3) = \vec{OP} + \frac{Lo}{L} \times \vec{PC} = \frac{1}{3 \times L} \times \begin{bmatrix} 2Lo + L & -Lo + L & -Lo + L \\ -Lo + L & 2Lo + L & -Lo + L \\ -Lo + L & -Lo + L & 2Lo + L \end{bmatrix} \begin{bmatrix} C1 \\ C2 \\ C3 \end{bmatrix} \tag{12}$$

As described above, the correction on the image data is performed such that all of the order colors after correction become order colors inside the order color displayable range without changing the hue and that gradation display is performed regarding the color having the high saturation.

<3.3 Effects>

Figure 29:
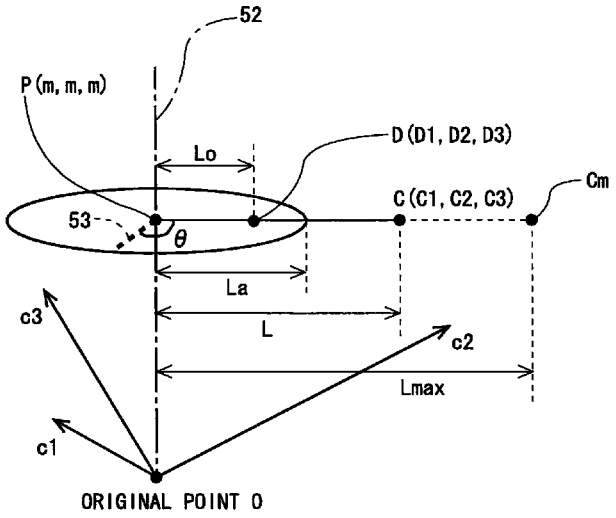
FIG. 29 is a diagram for explaining the color correction processing in a third embodiment of the present invention.
Figure 31:
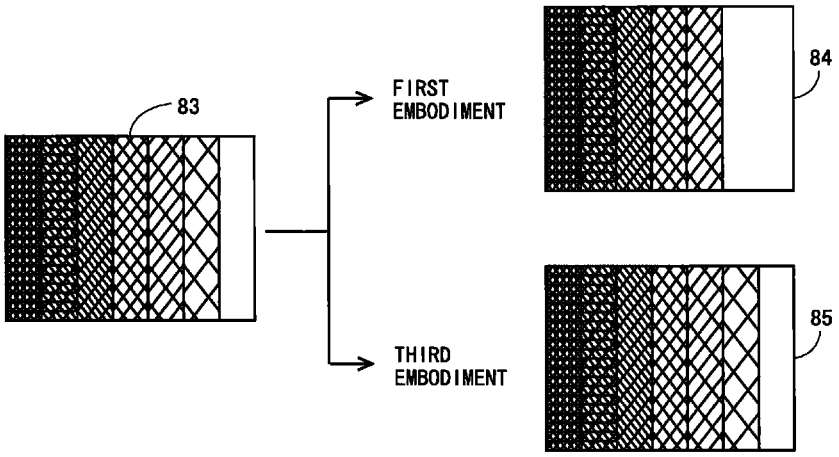
FIG. 31 is a diagram for explaining an effect in the third embodiment.

According to the present embodiment, regarding any order color, the coordinates of the point D corresponding to the order color after correction are determined such that "Lmax:L=La:Lo" is established, in the above-described display order color space (see FIG. 29). Thus, the correction of the image data is performed such that data of all colors become data of displayable colors and gradation display is performed also regarding the color having the high saturation. Schematically, for example, in a case in which gradation display as shown by reference character 83 in FIG. 31 is to be performed, although gradation display is not performed at the high saturation portion as shown by reference character 84 in FIG. 31 in the first embodiment, gradation display is performed also regarding the color having the high saturation as shown by reference character 85 in FIG. 31 in the present embodiment. Further, as in the first embodiment, the correction of the image data is performed such that the hue does not change. From the above, a liquid crystal display device employing the field sequential system, capable of suppressing occurrence of color shift, and capable of performing gradation display also regarding high saturation colors is realized.

<3.4 Modification>

In the third embodiment, as in the first embodiment, the distance from the achromatic point P to the point corresponding to the order color after correction is obtained based on the value of m and the value of cos θ. However, instead of this, the distance from the achromatic point P to the point corresponding to the order color after correction may be obtained depending on only the value of m without depending on the value of cos θ, as in the second embodiment.

4. Fourth Embodiment

<4.1 Outline and Overall Configuration>

Figure 32:
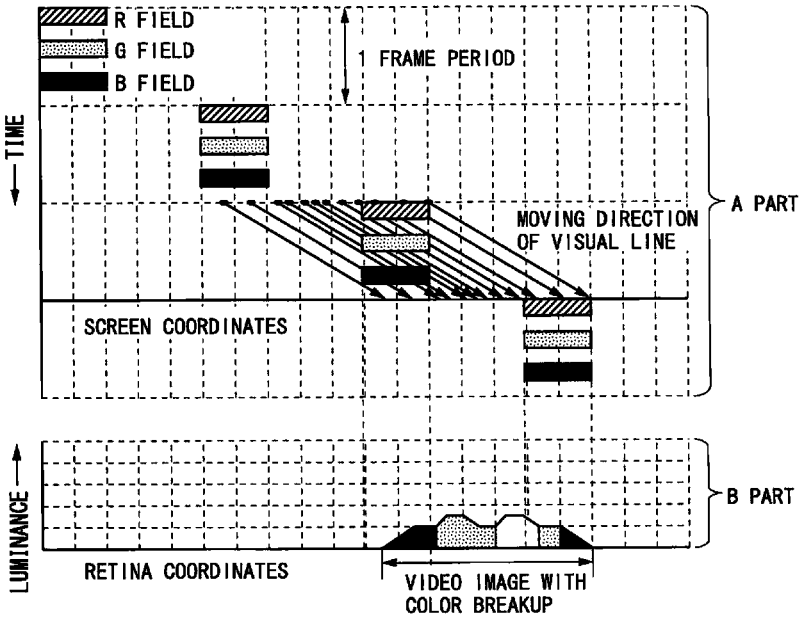
FIG. 32 is a diagram showing a principle of occurrence of color breakup.

As for the liquid crystal display device employing the field sequential system, there is conventionally known a problem of occurrence of color breakup. FIG. 32 is a diagram showing a principle of occurrence of color breakup. In an A part of FIG. 32, a vertical axis represents time and a horizontal axis represents a position on the screen. In general, when an object moves within the display screen, the visual line of the observer follows the object and moves in a moving direction of the object. For example, in the example shown in FIG. 32, when a white object moves from left to right within the display screen, the visual line of the observer moves in a direction of oblique arrows. On the other hand, when three field images of R, G, and B are extracted from a video image at the same moment, the position of the object in each field image is the same. For this reason, as shown in a B part of FIG. 32, color breakup occurs in a video image reflected on the retina. As one of measures against such color breakup, there has been made a proposal for providing in one frame period a field that displays a color not being any of the three primary colors, that is, a field for performing display with at least two colors (mixed-color display). Specifically, by providing a white field that displays a white screen in one frame period, the occurrence of color breakup is effectively suppressed. Therefore, in the present embodiment, a white field is provided in one frame period.

Figure 33:
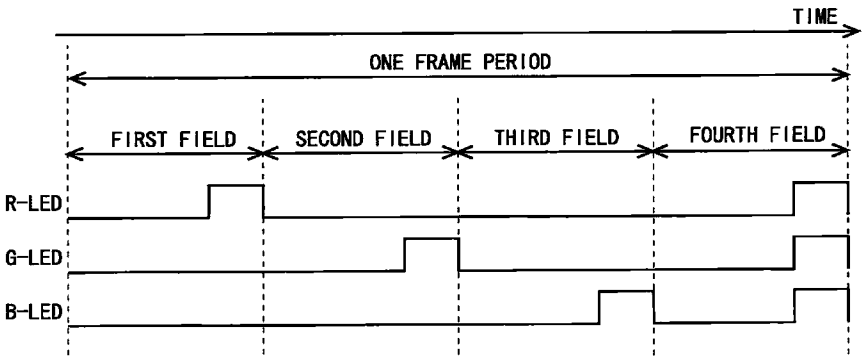
FIG. 33 is a diagram showing a configuration of one frame period in a fourth embodiment of the present invention.

FIG. 33 is a diagram showing a configuration of one frame period in the present invention. In the present embodiment, as lighting patterns, a first lighting pattern in which only the red LEDs are turned on, a second lighting pattern in which only the green LEDs are turned on, a third lighting pattern in which only the blue LEDs are turned on, and a fourth lighting pattern in which the red LEDs, the green LEDs, and the blue LEDs are turned on are prepared. Then, the lighting pattern repeatedly changes in the order of "the first lighting pattern, the second lighting pattern, the third lighting pattern, the fourth lighting pattern". That is, one frame period is divided into a first field (red field) in which a red screen is displayed, a second field (green field) in which a green screen is displayed, a third field (blue field) in which a blue screen is displayed, and a fourth field (white field) in which a white screen is displayed. It should be noted that, in the fourth field, the red LEDs, the green LEDs, and the blue LEDs are turned on in a part of the latter half. During the operation of the liquid crystal display device, these first field, second field, third field, fourth field are repeated. Thus, the red screen, the green screen, the blue screen, and the white screen are repeatedly displayed, and a desired color image is displayed on the display unit 410 while suppressing occurrence of color breakup. It should be noted that the order of the lighting patterns in the frame is not particularly limited. For example, lighting patterns may appear in the order of "the fourth lighting pattern, the third lighting pattern, the second lighting pattern, the first lighting pattern" (that is, colors may be displayed in the order of "white, blue, green, red").

Figure 34:
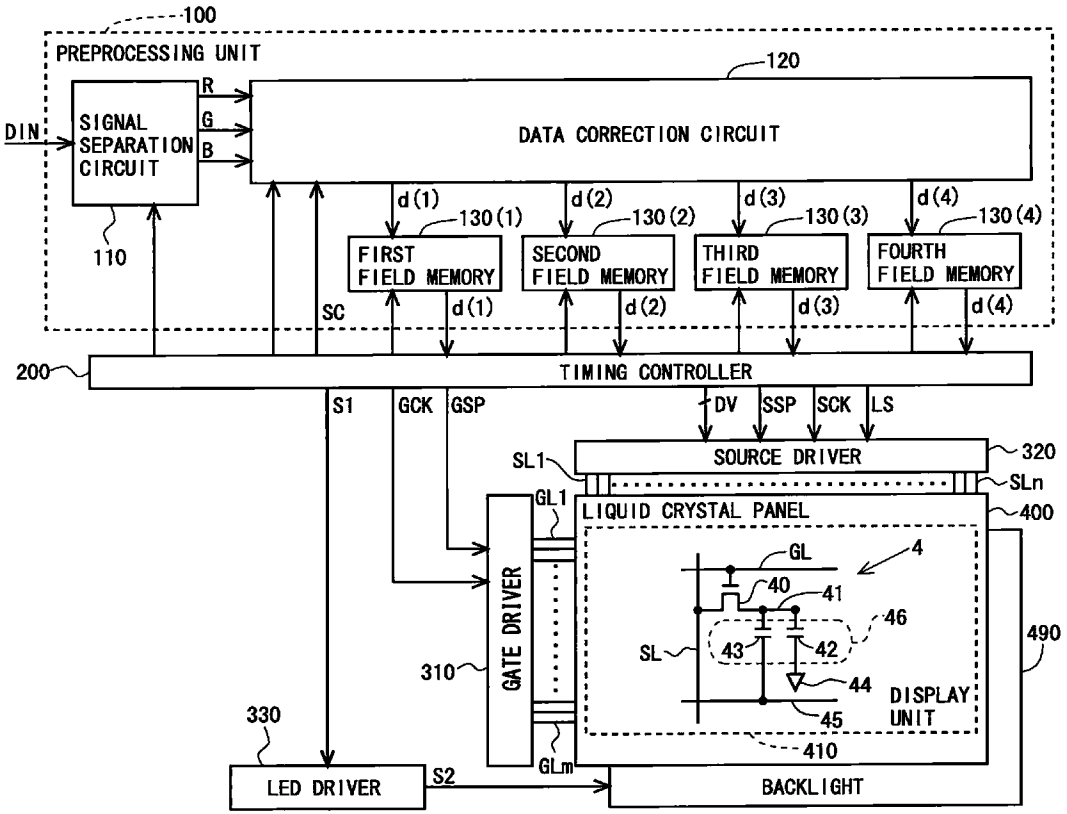
FIG. 34 is a block diagram showing an overall configuration of a liquid crystal display device according to the fourth embodiment.

FIG. 34 is a block diagram showing an overall configuration of the liquid crystal display device according to the present embodiment. In the present embodiment, in addition to the components in the first embodiment (see FIG. 9), the fourth field memory 130(4) is provided in the preprocessing unit 100. In the fourth field memory 130(4), the applied gradation data d(4) for the fourth field outputted from the data correction circuit 120 is stored.

<4.2 Data Correction Circuit>

Figure 35:
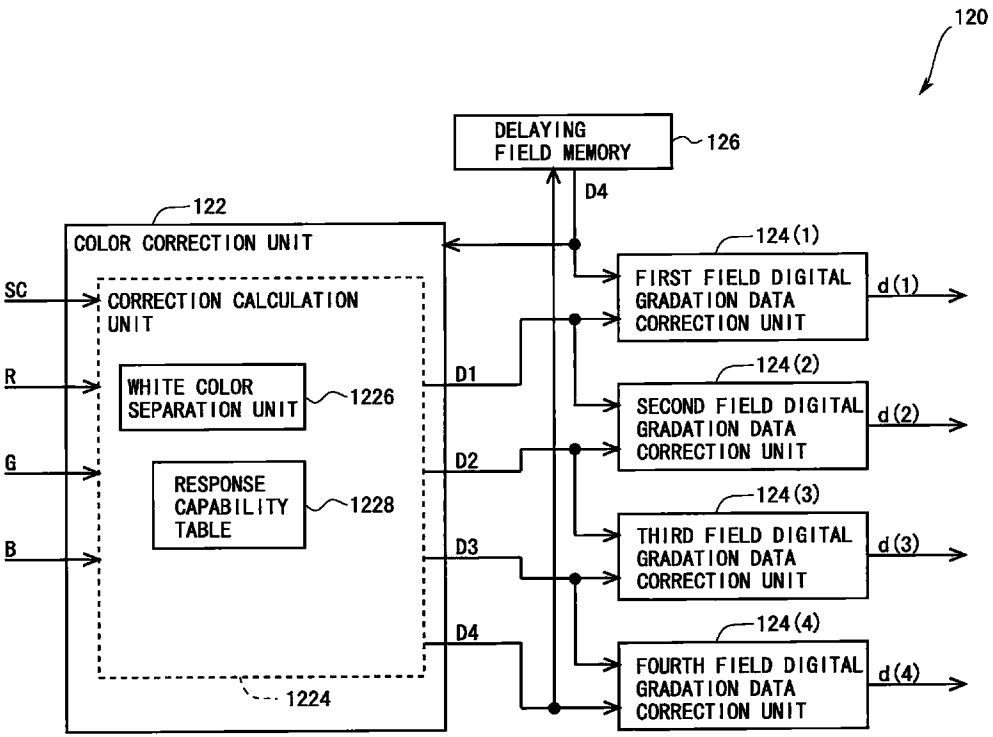
FIG. 35 is a block diagram showing a configuration of a data correction circuit in the fourth embodiment.

FIG. 35 is a block diagram showing a configuration of a data correction circuit 120 in the present embodiment. The data correction circuit 120 includes a color correction unit 122, a first field digital gradation data correction unit 124(1), a second field digital gradation data correction unit 124(2), a third field digital gradation data correction unit 124(3), a fourth field digital gradation data correction unit 124(4), and a delaying field memory 126. In the present embodiment, the color correcting unit 122 includes a correction calculation unit 1224 having a white color separation unit 1226 for performing a white color separation processing described below and a response capability table 1228 referred to when a color correction processing described below is performed. It should be noted that occurrence of color shift is suppressed even when displaying of moving image is performed as in the first modification of the first embodiment since the delaying field memory 126 is provided.

<4.2.1 Color Correction Unit>

To the correction calculation unit 1224 in the color correction unit 122, the color order signal SC outputted from the timing controller 200 and the input gradation data (red input gradation data R, green input gradation data G, and blue input gradation data B) outputted from the signal separation circuit 110 are inputted. The color order signal SC is a signal indicating the display order of colors in the frame. In the present embodiment, the color order signal SC indicates that the display order of the colors in the frame is "red, green, blue, white". The correction calculation unit 1224 performs the color correction processing described below on the input gradation data and outputs data after correction as the first to third digital gradation data D1 to D3.

Figure 36:
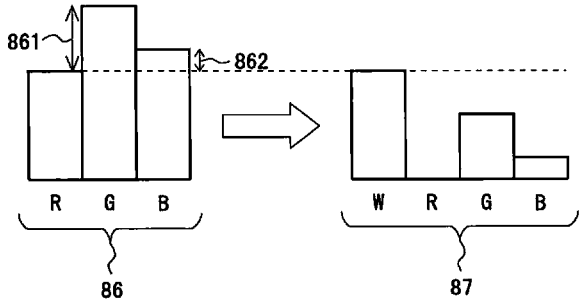
FIG. 36 is a diagram for explaining a white color separation processing in the fourth embodiment.

In the present embodiment, in order to display a white screen in the fourth field, a processing for separating white data from RGB data (hereinafter referred to as "white color separation processing") is performed at the time of color correction processing. The data conversion by this white color separation processing will be described. For example, it is assumed that components of each color before conversion are as shown by reference character 86 in FIG. 36. At this time, among the red component (R), the green component (G), and the blue component (B), the red component is the minimum component. In such a case, the magnitude of the white component (W) is set to be equal to the magnitude of the red component before conversion. Then, the magnitude of the green component after conversion is set to the magnitude indicated by reference character 861 in FIG. 36, and the magnitude of the blue component after conversion is set to the magnitude indicated by reference character 862 in FIG. 36. It should be noted that, at this time, the magnitude of the red component after conversion is set to zero. As a result, the components of colors after conversion are as indicated by reference character 87 in FIG. 36.

From the above, when assuming that the magnitude of the red component, the magnitude of the green component, and the magnitude of the blue component before the white color separation processing are represented by R1, G1, and B1, respectively, and the magnitude of the white component, the magnitude of the red component, the magnitude of the green component, and the magnitude of the blue component after the white color separation processing are represented by W2, R2, G2, and B2, respectively, W2, R2, G2, and B2 are obtained by the following equations (13), (14), (15), and (16), respectively.

$$W2=Z \tag{13}$$

$$R2=R1-Z \tag{14}$$

$$G2=G1-Z \tag{15}$$

$$B2=B1-Z \tag{16}$$

Here, when assuming that the function representing the minimum value among x, y, and z is defined as min (x, y, z), Z=min (R1, G1, B1) holds true in the above equation (13).

It should be noted that the calculus equation for the component of each color is not limited to the above equations (13) to (16). For example, the magnitude W2 of the white component, the magnitude R2 of the red component, the magnitude G2 of the green component, and the magnitude B2 of the blue component after white color separation processing may be obtained by the following equations (17), (18), (19), and (20), respectively, using a separation coefficient k which is an integer from 0 to 1.

$$W2=kZ \tag{17}$$

$$R2=R1-kZ \tag{18}$$

$$G2=G1-kZ \tag{19}$$

$$B2=B1-kZ \tag{20}$$

Next, the color correction processing in the present embodiment will be described in detail. The order color displayable range can be estimated by the response characteristics of the liquid crystal in each liquid crystal display device. Regarding the liquid crystal display device that sequentially displays four colors as in the present embodiment, the order color displayable range is estimated as a range of the four dimensional space. Thus, it is possible to prepare a conversion table that associates data before correction and data after correction for each display order, and correct data using the conversion table. However, in order to store the data of the four dimensional space in the conversion table, a huge memory capacity is required. Therefore, in the present embodiment, occurrence of color breakup and occurrence of color shift are suppressed without providing a huge memory capacity by performing the color correction processing as described below.

Figure 37:
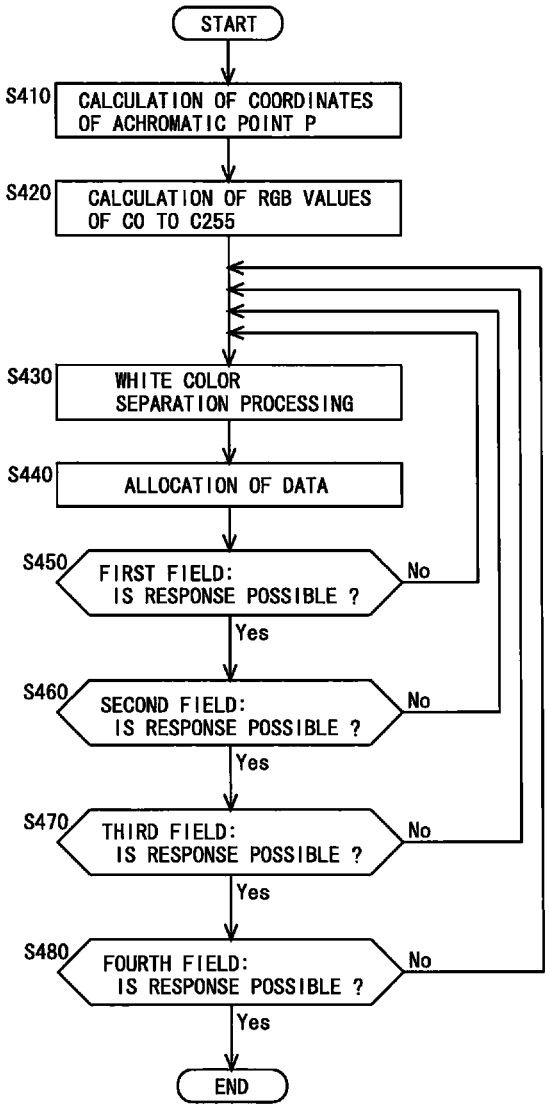
FIG. 37 is a flowchart showing a detailed procedure of the color correction processing performed by the correction calculation unit in the fourth embodiment.

FIG. 37 is a flowchart showing a detailed procedure of the color correction processing performed by the correction calculation unit 1224 in the present embodiment. It is assumed that a point (a point on the RGB color space) corresponding to the focused color (RGB data) is represented by C and the coordinates of the point C are (C1, C2, C3) (see FIG. 38). After the start of the color correction processing, first, the coordinates of the achromatic point P corresponding to the point C in the RGB color space are obtained based on the input gradation data (the red input gradation data R, the green input gradation data G, and the blue input gradation data B) (step S410). As for this achromatic point P, the R value, the G value, and the B value are equal. That is, the coordinates of the point P are represented by (m, m, m). The value of m is calculated by the above equation (1) as in the first embodiment. In this way, the coordinates of the achromatic point P corresponding to the point C are obtained.

Next, the coordinates (RGB values) of C(0) to C(255) when assuming that 256 points dividing a line segment connecting the point C and the point P into 255 equal parts are represented by C(0) to C(255) are obtained (step S420). It should be noted that the point C(0) is the point C and the point C(255) is the point P.

Thereafter, it is determined whether or not the order color corresponding to each point is a color inside the displayable range until the point corresponding to the order colors inside the displayable range is specified, in the order of "point C(0), point C(1), point C(2), . . . , point C(255)" (step S430 to step S480). Thus, the displayable range for the color having the same hue as the color corresponding to the point C is estimated, and the data value of the color after correction is determined based on the estimation result.

As described above, the processings of step S430 to step S480 are performed one point by one point in the order of "point C(0), point C(1), point C(2), . . . , point C(255)" until the point corresponding to the order colors inside the displayable range is specified. Here, the point being processed out of the points C(0) to C(255) is referred to as "target processing point". Hereinafter, the processings of step S430 to step S480 will be described.

First, the above-described white color separation processing is performed on the data of the target processing point (step S430). By this white color separation processing, four data values Wa, Ba, Ga, and Ba are calculated. Then, allocating four data values (Wa, Ra, Ga, and Ba) to the four fields (first to fourth fields) is performed (step S440).

Next, regarding each field, it is determined whether or not response is possible, based on the data value (display field value) of the display field (field to be judged) and the data value (preceding field value) of the field preceding the display field (step S450 to step S480). It should be noted that the term "response is possible" here means that the liquid crystal responds so that a target transmittance can be obtained within a predetermined time when a voltage corresponding to the data value allocated to each field is applied to the liquid crystal.

Figures 38, 39:
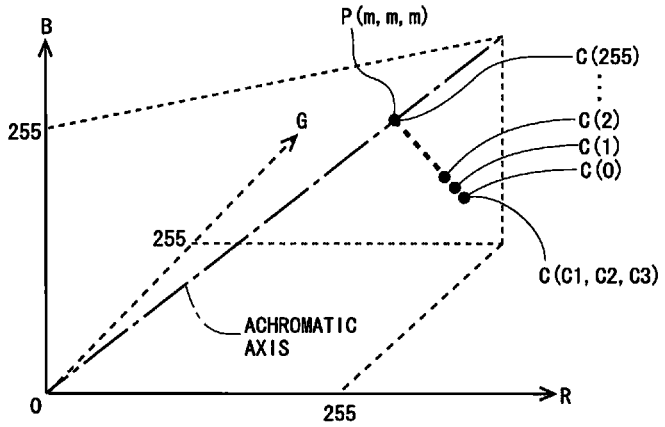
FIG. 38 is a diagram for explaining the color correction processing in the fourth embodiment.
FIG. 39 is a schematic diagram of a response capability table in the fourth embodiment.

Incidentally, in the present embodiment, a response capability table 1228 as shown in FIG. 39 is held in the correction calculation unit 1224 in order to determine whether or not response is possible. The response capability table 1228 stores a value indicating whether or not response is possible, corresponding to the combination of the display field value and the preceding field value. It should be noted that only the main values are shown as the display field values and the previous field values in FIG. 39. In the example shown in FIG. 39, "1" indicates that response is possible, and "0" indicates that response is impossible. For example, when the display field value is "32" and the preceding field value is "192", a determination is made that response is possible. Further, for example, when the display field value is "255" and the preceding field value is "192", a determination is made that response is impossible. As described above, in step S450 to step S480, it is determined whether or not response is possible with respect to each field by using the response capability table 1228.

Specifically, first, it is determined whether or not response is possible with respect to the first field, based on the data value of the first field and the data value of the fourth field of the preceding frame (step S450). As a result of the determination, when it is determined that response is possible, the processing proceeds to step S460, and when it is determined that response is impossible, the processing returns to step S430. When the processing returns to step S430, the next point becomes the target processing point.

In step S460, it is determined whether or not response is possible with respect to the second field, based on the data value of the second field and the data value of the first field. As a result of the determination, when it is determined that response is possible, the processing proceeds to step S470, and when it is determined that response is impossible, the processing returns to step S430.

In step S470, it is determined whether or not response is possible with respect to the third field, based on the data value of the third field and the data value of the second field. As a result of the determination, when it is determined that response is possible, the processing proceeds to step S480, and when it is determined that response is impossible, the processing returns to step S430.

In step S480, it is determined whether or not response is possible with respect to the fourth field, based on the data value of the fourth field and the data value of the third field. As a result of the determination, when it is determined that response is impossible, the processing returns to step S430. On the other hand, when it is determined that response is possible, the data value of the target processing point at the time, that is obtained after performing allocation to each field in step S440, is set as the corrected data value of the point C. The data values obtained as described above are outputted as the first to fourth digital gradation data D1 to D4 from the correction calculation unit 1224.

For example, in a case in which it is determined that response is possible in the above step S480 when the target processing point is point C(10), the data value obtained based on the data value of the point C(10) is set as the corrected data value of the color corresponding to the point C. More specifically, in this case, data values obtained by allocating the four data values (Wa, Ra, Ga, and Ba) that are obtained by performing the white color separation processing on the data value (RGB value) of the point C(10) to four fields (first to fourth fields) are set as the corrected data values of the color corresponding to the point C.

<4.2.2 Digital Gradation Data Correction Unit>

Next, the digital gradation data correction unit will be described. The first field digital gradation data correction unit 124(1) receives the first digital gradation data D1 and the fourth digital gradation data D4 stored in the delaying field memory 126 (namely, the fourth digital gradation data D4 of the preceding frame), and performs correction for overdrive on the first digital gradation data D1 depending on the data value (gradation value) of the fourth digital gradation data D4. The second field digital gradation data correction unit 124(2) receives the first digital gradation data D1 and the second digital gradation data D2, and performs correction for overdrive on the second digital gradation data D2 depending on the data value (gradation value) of the first digital gradation data D1. The third field digital gradation data correction unit 124(3) receives the second digital gradation data D2 and the third digital gradation data D3, and performs correction for overdrive on the third digital gradation data D3 depending on the data value (gradation value) of the second digital gradation data D2. The fourth field digital gradation data correction unit 124(4) receives the third digital gradation data D3 and the fourth digital gradation data D4, and performs correction for overdrive on the fourth digital gradation data D4 depending on the data value (gradation value) of the third digital gradation data D3. It should be noted that the method of correcting the gradation value in each digital gradation data correction unit 124 is the same as that in the first embodiment.

<4.3 Effects>

According to the present embodiment, in the liquid crystal display device employing the field sequential system, data of a color that can not be displayed is corrected to data of a displayable color by lowering the saturation without changing the hue, similarly to the first embodiment. Further, in the present embodiment, one frame period includes the first field displaying the red screen, the second field displaying the green screen, the third field displaying the blue screen, and the fourth field displaying the white screen. That is, one frame period includes a field in which displaying of the mixed color components of the three primary colors is performed, in addition to three fields in which monochromatic display of each of the three primary colors is performed. Accordingly, occurrence of color breakup is suppressed. From the above, a liquid crystal display device employing the field sequential system and capable of suppressing occurrence of color shift while suppressing occurrence of color breakup is realized.

<4.4 Modification>

In the fourth embodiment, one frame period is divided into four fields, and each of the first to fourth lighting patterns appears once in each frame. However, the present invention is not limited to this. The configuration in which the number of fields included in one frame period is larger than the number of lighting patterns (configuration in the present modification) may be adopted.

Figure 40:
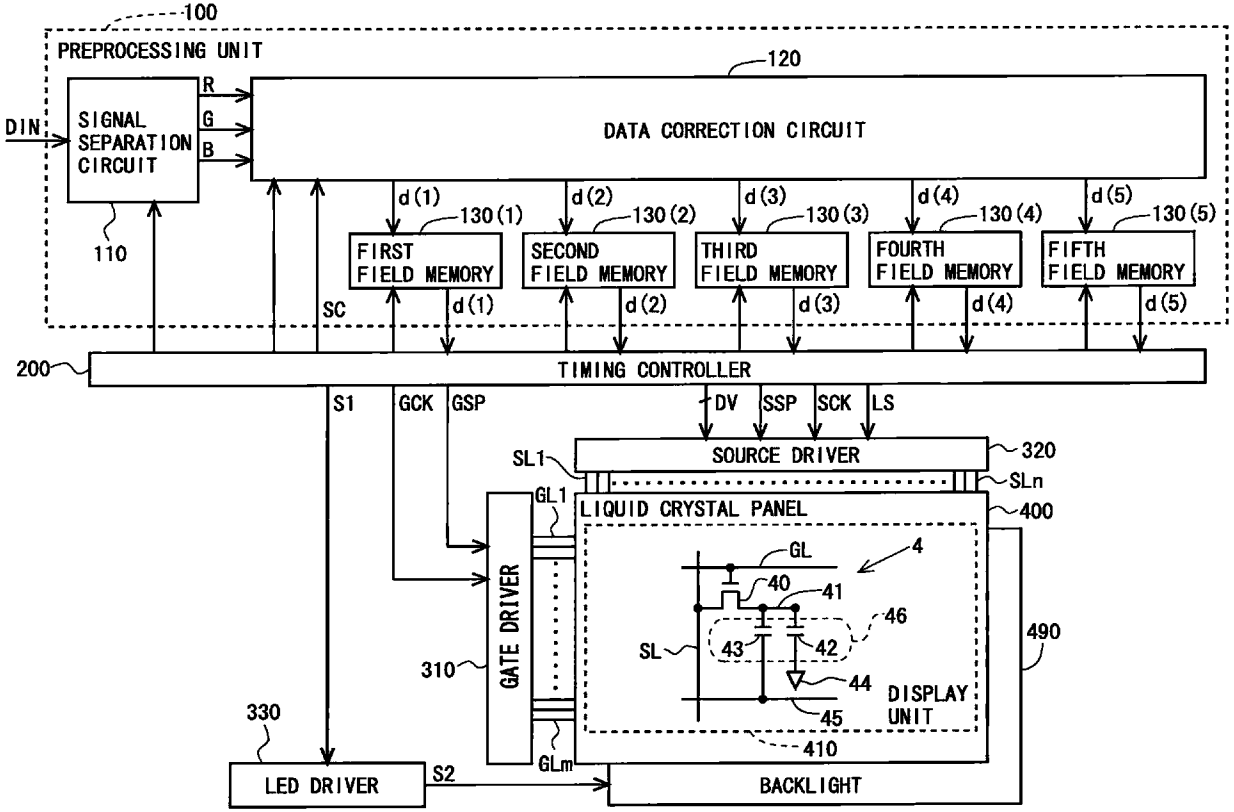
FIG. 40 is a block diagram showing an overall configuration of a liquid crystal display device in a modification of the fourth embodiment.

FIG. 40 is a block diagram showing an overall configuration of a liquid crystal display device according to the present modification. In the present modification, in addition to the components in the fourth embodiment (see FIG. 34), a fifth field memory 130(5) is provided in the preprocessing unit 100. Then, one frame period is divided into five fields (first to fifth fields). Regarding the lighting patterns, four lighting patterns (first to fourth lighting patterns) similar to those of the fourth embodiment are prepared. That is, one frame period is divided into a plurality of fields, the number of the fields is larger than the number of lighting patterns. In the fifth field memory 130(5), the applied gradation data d(5) for the fifth field outputted from the data correction circuit 120 is stored.

Figure 41:
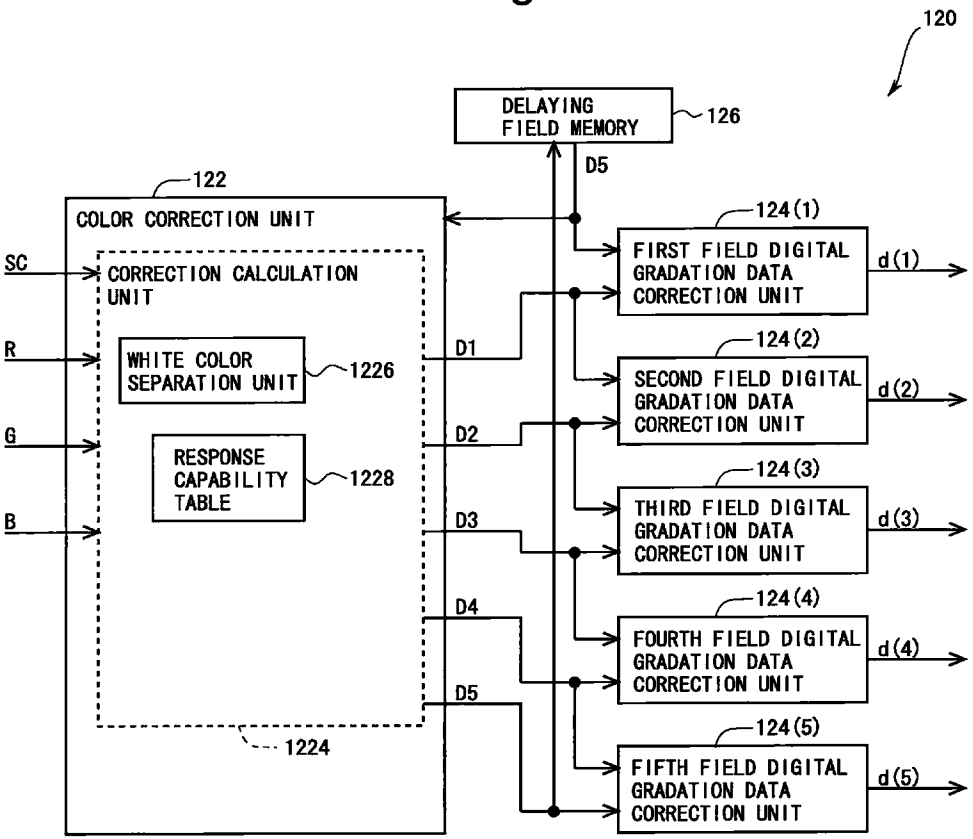
FIG. 41 is a block diagram showing a configuration of a data correction circuit in the modification of the fourth embodiment.

FIG. 41 is a block diagram showing a configuration of the data correction circuit 120 in the present modification. This data correction circuit 120 is provided with a fifth field digital gradation data correction unit 124(5) in addition to the components in the fourth embodiment (see FIG. 35). The fifth field digital gradation data correction unit 124(5) receives the fourth digital gradation data D4 and the fifth digital gradation data D5, and performs correction for overdrive on the fifth digital gradation data D5 depending on the data value (gradation value) of the fourth digital gradation data D4.

Figure 42:
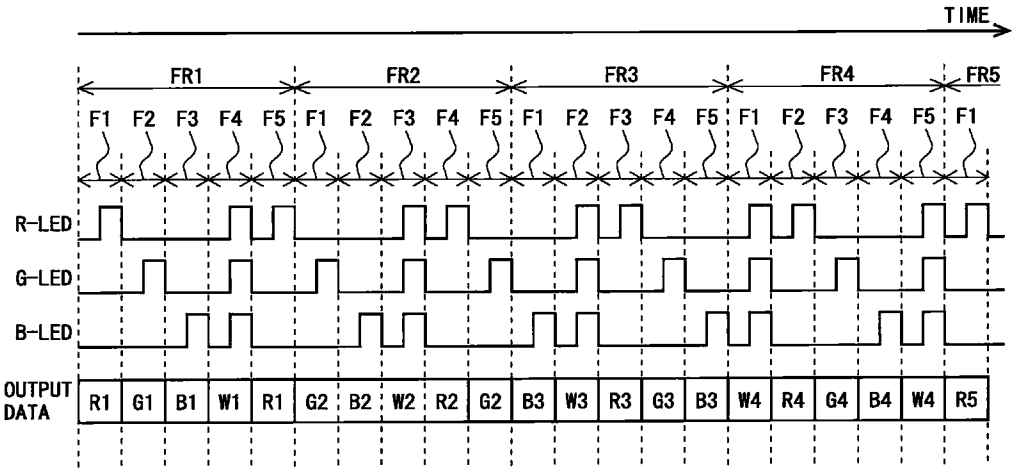
FIG. 42 is a diagram for explaining a configuration of frames in the modification of the fourth embodiment.

FIG. 42 is a diagram for explaining a configuration of frames in the present modification. In the present modification, display order of colors (order in which lighting patterns appear) in each frame is determined as follows with four frames (the first frame FR1 to the fourth frame FR4 in FIG. 42) as one unit.

First frame FR1
First field F1: red (first lighting pattern)
Second field F2: green (second lighting pattern)
Third field F3: blue (third lighting pattern)
Fourth field F4: white (fourth lighting pattern)
Fifth field F5: red (first lighting pattern)
Second frame FR2
First field F1: green (second lighting pattern)
Second field F2: blue (third lighting pattern)
Third field F3: whit (fourth lighting pattern)
Fourth field F4: red (first lighting pattern)
Fifth field F5: green (second lighting pattern)
Third frame FR3
First field F1: blue (third lighting pattern)
Second field F2: white (fourth lighting pattern)
Third field F3: red (first lighting pattern)
Fourth field F4: green (second lighting pattern)
Fifth field F5: blue (third lighting pattern)
Fourth frame FR4
First field F1: white (fourth lighting pattern)
Second field F2: red (first lighting pattern)
Third field F3: green (second lighting pattern)
Fourth field F4: blue (third lighting pattern)
Fifth field F5: white (fourth lighting pattern)

Since display order of colors (order in which lighting patterns appear) differs depending on the frame as described above, the value of the color order signal SC given from the timing controller 200 to the correction calculation unit 1224 changes for each frame.

Figure 43:
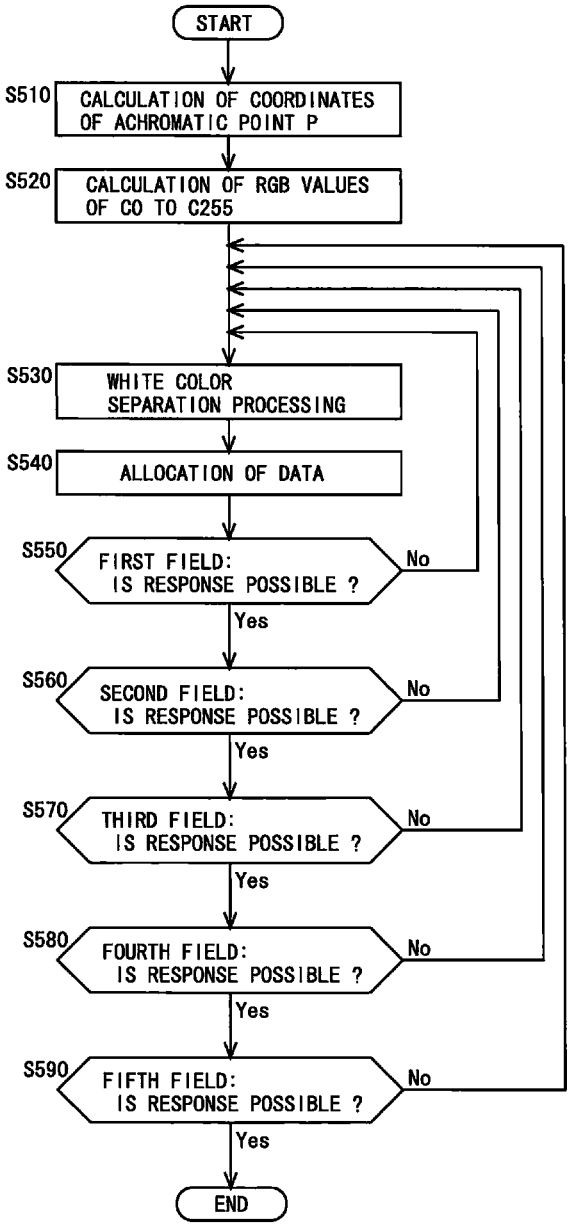
FIG. 43 is a flowchart showing a detailed procedure of the color correction processing performed by the correction calculation unit in the modification of the fourth embodiment.
Figure 44:
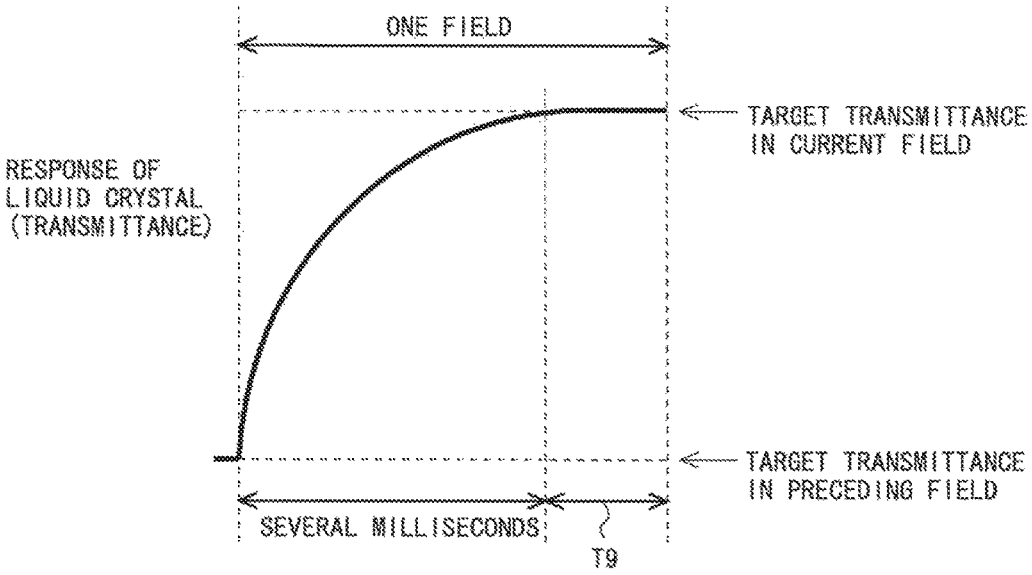
Fig.44 Prior Art
FIG. 44 is a diagram for explaining a response of the liquid crystal in the liquid crystal display device employing the field sequential system.
Figure 45:
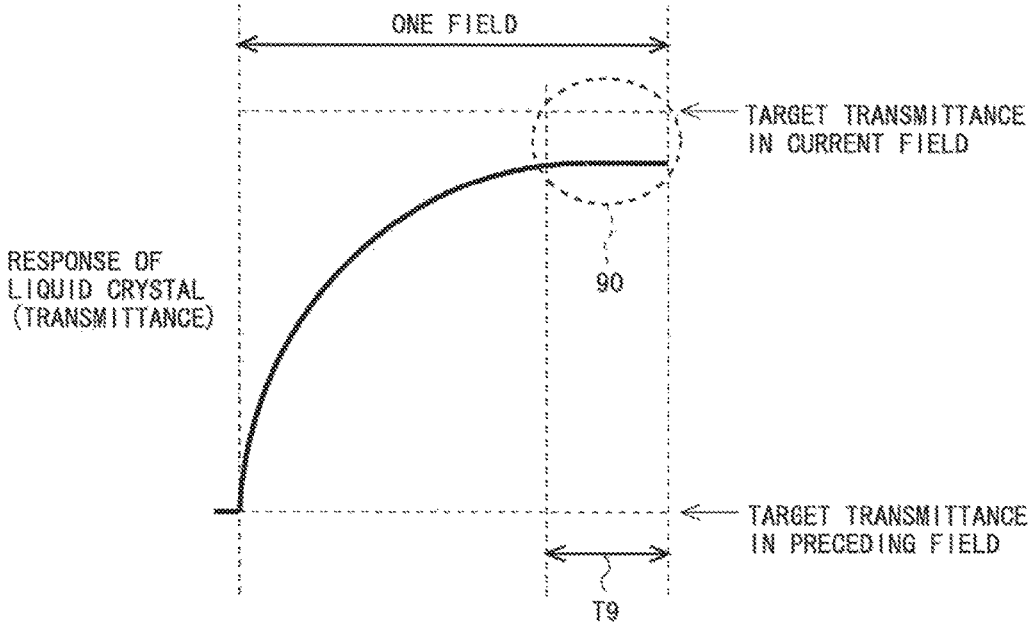
Fig.45 Prior Art
FIG. 45 is a diagram for explaining a fact that the transmittance at the pixel does not reach the target transmittance within one field regarding the liquid crystal display device employing the field sequential system.
Figure 46:
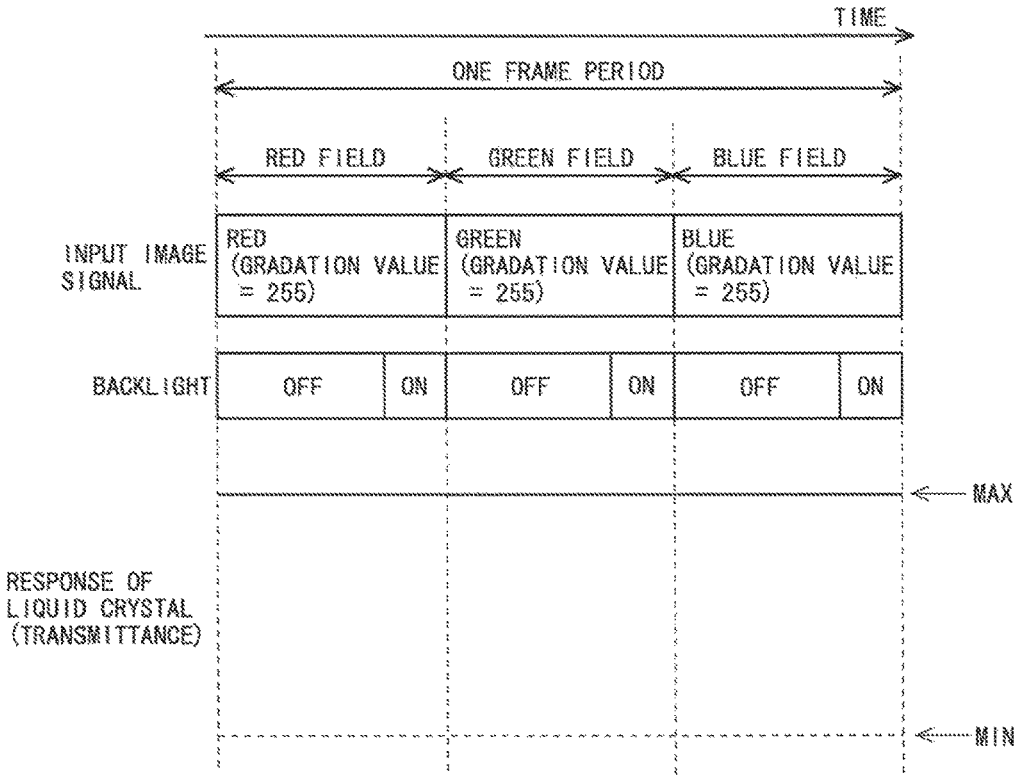
Fig.46 Prior Art
FIG. 46 is a diagram for explaining a phenomenon when a white image is displayed in the liquid crystal display device employing the field sequential system.

FIG. 43 is a flowchart showing a detailed procedure of the color correction processing performed by the correction calculation unit 1224 in the present modification. In step S510 to step S530, the same processings as step S410 to step S430 in the fourth embodiment (see FIG. 37) are performed. In step S540, allocating four data values (Wa, Ra, Ga, and Ba) to the five fields (first to fifth fields) is performed according to the display order indicated by the color order signal SC. In step S550, it is determined whether or not response is possible with respect to the first field, based on the data value of the first field and the data value of the fifth field of the preceding frame. In step S560 to step S580, the same processings as step S460 to step S480 in the fourth embodiment (see FIG. 37) are performed. In step S590, it is determined whether or not response is possible with respect to the fifth field, based on the data value of the fifth field and the data value of the fourth field. As described above, as in the fourth embodiment, the data value of the color (order color) after correction is obtained.

According to the present modification, as in the fourth embodiment, in the liquid crystal display device employing the field sequential system, it is possible to suppress the occurrence of color shift while suppressing occurrence of color breakup. Further, similar to the second modification of the first embodiment, the occurrence of flicker is suppressed since the apparent refresh rate (frequency of change in luminance) is increased.

5. Others

The present invention is not limited to each of the above-described embodiments (including modifications), and various modifications can be made without departing from the scope of the present invention.

DESCRIPTION OF REFERENCE CHARACTERS

100: preprocessing unit
110: signal separation circuit
120: data correction circuit
122: color correction unit
124(1) to 124(5): first to fifth field digital gradation data correction unit
125: gradation value conversion look-up table
126: delaying field memory
128(1) to 128(3): first to third displaying color digital gradation data correction unit
130(1) to 130(5): first to fifth field memory
200: timing controller
310: gate driver
320: source driver
330: LED driver
400: liquid crystal panel
410: display unit
490: backlight
1222: data allocating unit
1224: correction calculation unit
1226: white color separation unit
1228: response capability table

The invention claimed is:

1. A liquid crystal display device employing a field sequential system, the liquid crystal display device having a backlight including light sources of a plurality of colors and configured to perform color display by switching a lighting pattern representing a combination of a lighted state and an unlighted state of the light sources of the plurality of colors in every field, the liquid crystal display device comprising:

a liquid crystal panel configured to display an image;

a color correction unit configured to perform a color correction processing that changes a saturation of input pixel data representing a color of a pixel without changing a hue thereof and configured to output pixel data obtained by the color correction processing as digital gradation data which are data corresponding to each field, the color correction unit includes a field allocating unit and a correction calculation unit;

a digital gradation data correction unit configured to perform correction that enhances a temporal change of data values of digital gradation data outputted from the color correction unit; and a liquid crystal panel driving unit configured to drive the liquid crystal panel based on digital gradation data after correction by the digital gradation data correction unit;

wherein the color correction unit performs the color correction processing on the input pixel data such that a color based on pixel data obtained by the color correction processing is a color that can be displayable in the liquid crystal panel by the field sequential system;

wherein the field allocating unit configured to allocate data of a plurality of colors to a respective field based on display order of colors in a frame, the data of the plurality of colors being included in the input pixel data; and wherein the correction calculation unit configured to perform a calculation processing using a calculation circuit, as the color correction processing, and the correction calculation unit performs the calculation processing based on order data that are data obtained by allocating the data of the plurality of colors to the respective field by the field allocating unit, without considering colors in the frame.

2. The liquid crystal display device according to claim 1, wherein when the color indicated by the input pixel data is a color outside a displayable range in the field sequential system, the color correction unit performs the color correction processing on the input pixel data such that a color based on pixel data obtained by the color correction processing is a color corresponding to a part, among a region representing the displayable range, that is in contact with a region outside the displayable range, on a color space.

3. The liquid crystal display device according to claim 2, wherein, when, on the color space, a color indicated by the input pixel data is represented by a point C, an intersection of the plane including the point C and having an achromatic axis as a normal and the achromatic axis is represented by a point P, and a point corresponding to a color based on pixel data after correction is represented by D, the color correction unit decides on a distance from the point P to the point D based on coordinates of the point P and an angle between a line segment PC and a straight line obtained by projecting one axis forming the color space on the plane having the achromatic axis as a normal.

4. The liquid crystal, display device according to claim 2, wherein when, on the color space, a color indicated by the input pixel data is represented by a point C, an intersection of the plane including the point C and having an achromatic axis as a normal and the achromatic axis is represented by a point P, and a point corresponding to a color based on pixel data after correction is represented by D, the color correction unit decides on a distance from the point P to the point D based on coordinates of the point P.

5. The liquid crystal, display device according to claim 1, wherein when, on a color space, a color indicated by the input pixel data is represented by a point C, an intersection of the plane including the point C and having an achromatic axis as a normal and the achromatic axis is represented by a point P, a point corresponding to a color based on pixel data after correction is represented by D, a distance from a part, among a region representing a displayable range, that is in contact with a region outside the displayable range to the point P is represented by La, and a maximum value that can be taken as a distance from the point P to a point corresponding to a color indicated by the input pixel data is represented by Lmax, the color correction unit decides on a distance from the point P to the point D such that a ratio of a length of a line segment PC to Lmax is equal to a ratio of a length of a line segment PD to La.

6. The liquid crystal display device according to claim 1, wherein one frame period is divided into a plurality of fields, the number of the fields is larger than the number of lighting patterns, and a cycle in which a same lighting pattern appears is shorter than a cycle in which input pixel data for one frame period are inputted.

7. The liquid crystal display device according to claim 1, wherein when any field among fields included in each frame period is defined as a focused field, a data value of digital gradation data corresponding to the focused field is defined as a display field value, and a data value of digital gradation data corresponding to a preceding field of the focused field is defined as a preceding field value, the digital gradation data correction unit corrects the display field value obtained by the color correction unit depending on the preceding field value obtained by the color correction unit.

8. The liquid crystal display device according to claim 7, further comprising a field memory that can hold digital gradation data, for one screen, corresponding to a last field of each frame period among digital gradation data obtained by the color correction unit.

9. The liquid crystal display device according to claim 1, wherein the liquid crystal panel includes pixel electrodes arranged in matrix, a common electrode arranged to face the pixel electrodes, a liquid crystal sandwiched between the pixel electrodes and the common electrode, scanning signal lines, video signal lines to which video signals depending on digital gradation data after correction by the digital gradation data correction unit are applied, and thin film transistors each having a control terminal connected to one of the scanning signal lines, a first conduction terminal connected to one of the video signal lines, and a second terminal connected to one of the pixel electrodes, a channel layer of each of the thin film transistors are formed with an oxide semiconductor.

10. The liquid crystal display device according to claim 9, wherein main components of the oxide semiconductor include an indium, a gallium, a zinc, and an oxygen.

11. A liquid crystal display device employing a field sequential system, the liquid crystal display device having a backlight including light sources of a plurality of colors and configured to perform color display by switching a lighting pattern representing a combination of a lighted state and an unlighted state of the light sources of the plurality of colors in every field, the liquid crystal display device comprising:

a liquid crystal panel configured to display an image;

a color correction unit configured to perform a color correction processing that changes a saturation of input pixel data representing a color of a pixel without changing a hue thereof and configured to output pixel data obtained by the color correction processing as digital gradation data which are data corresponding to each field;

a digital gradation data correction unit configured to perform correction that enhances a temporal change of data values of digital gradation data outputted from the color correction unit; and a liquid crystal panel driving unit configured to drive the liquid crystal panel based on digital gradation data after correction by the digital gradation data correction unit;

the color correction unit performs the color correction processing on the input pixel data such that a color based on pixel data obtained by the color correction processing is a color that can be displayable in the liquid crystal panel by the field sequential system;

wherein one frame period includes a field in which light sources of two or more colors among the light sources of the plurality of colors are turned on;

wherein the light sources of the plurality of colors include red light sources, green light sources, and blue light sources, and one frame period is divided into four or more fields including a red field in which only the red light sources are turned on, a green field in which only the green light sources are turned on, a blue field in which only the blue light sources are turned on, and a white field in which the red light sources, the green light sources, and the blue light sources are turned on, the four or more fields including at least one field as the red field, at least one field as the green field, at least one field as the blue field, and at least one field as the white field; and wherein when, on a color space, a color indicated by the input pixel data is represented by a point C, and an intersection of the plane including the point C and having an achromatic axis as a normal and the achromatic axis is represented by a point P, the color correction unit sets points on a line segment CP as target processing points one by one from the point C to the point P, determines whether or not each of the target processing points is a point corresponding to a color inside a displayable range, and decides on, based on the determination result, coordinates of a point corresponding to a color based on pixel data after correction.

12. The liquid crystal display device according to claim 11, wherein the color correction unit allocates data corresponding to each lighting pattern to the four or more fields, the data corresponding to each lighting pattern being obtained by performing a processing that separates a white component from data of each of the target processing points, and when response is possible in all of the four or more fields, the color correction unit makes a determination that a target processing point is a point corresponding to a color inside the displayable range.

13. A method of driving a liquid crystal display device employing a field sequential system, the liquid crystal display device having a liquid crystal panel configured to display an image and a backlight including light sources of a plurality of colors and configured to perform color display by switching a lighting pattern representing a combination of a lighted state and an unlighted state of the light sources of the plurality of colors in every field, the method comprising:

a color correction step of performing a color correction processing that changes a saturation of input pixel data representing a color of a pixel without changing a hue thereof and outputting pixel data obtained by the color correction processing as digital gradation data which are data corresponding to each field, the color correction step including a field allocating step and a correction calculation step;

a digital gradation data correction step of performing correction that enhances a temporal change of data values of digital gradation data outputted by the color correction step; and a liquid crystal panel driving step of driving the liquid crystal panel based on digital gradation data after correction by the digital gradation data correction step; and in the color correction step, the color correction processing is performed on the input pixel data such that a color based on pixel data obtained by the color correction processing is a color that can be displayable in the liquid crystal panel by the field sequential system;

wherein the field allocating step allocates data of a plurality of colors to a respective field based on display order of colors in a frame, the data of the plurality of colors being included in the input pixel data; and wherein the correction calculation step performs a calculation processing using a calculation circuit, as the color correction processing, and the correction calculation step performs the calculation processing based on order data that are data obtained by allocating the data of the plurality of colors to the respective field by the field allocating unit, without considering colors in the frame.

* * * * *